US007631752B2

(12) United States Patent
Painsith

(10) Patent No.: US 7,631,752 B2
(45) **Date of Patent: *Dec. 15, 2009**

(54) CARD-SHAPED STORAGE CASE FOR ARTICLES OF DAILY USE AND/OR CONSUMER ARTICLES

(75) Inventor: Hermann Painsith, Klagenfurt (AT)

(73) Assignee: Victorinox AG, Ibach-Schwyz (CH)

( * ) Notice: Subject to any disclaimer, the term of this patent is extended or adjusted under 35 U.S.C. 154(b) by 0 days.

This patent is subject to a terminal disclaimer.

(21) Appl. No.: 10/265,103

(22) Filed: Oct. 7, 2002

(65) Prior Publication Data

US 2003/0038043 A1 Feb. 27, 2003

Related U.S. Application Data

(60) Continuation of application No. 09/851,783, filed on Jun. 22, 2001, now Pat. No. 6,527,112, which is a continuation of application No. 09/460,268, filed on Dec. 13, 1999, now Pat. No. 6,257,405, which is a division of application No. 09/077,482, filed as application No. PCT/AT96/00238 on Dec. 2, 1996, now Pat. No. 6,044,967.

(30) Foreign Application Priority Data

Nov. 30, 1995 (AT) ..... 1961/95

(51) Int. Cl.
*B65D 69/00* (2006.01)

(52) U.S. Cl. ..... 206/234; 206/37; 206/349

(58) Field of Classification Search ..... 206/37, 206/37.1, 37.4, 38, 38.1, 216, 234–241, 349, 206/372, 373

See application file for complete search history.

(56) References Cited

U.S. PATENT DOCUMENTS 4,562,923 A * 1/1986 Katada et al. ..... 206/235
5,328,026 A * 7/1994 Newman ..... 206/234
5,467,871 A * 11/1995 DeField ..... 206/37.1

* cited by examiner

*Primary Examiner*—Luan K Bui
(74) *Attorney, Agent, or Firm*—Edwards Angell Palmer & Dodge LLP

(57) ABSTRACT

The invention relates to a card-shaped storage case (1) made of metal or plastic with at least one internal storage compartment (8) for at least one article, which is defined by a base plate (6) and at least in sections by a cover plate (7) of the storage case (1) running parallel to this, wherein several storage compartments (8) at least partially separate from one another are arranged in the storage case (1) in a plane running parallel to the base plate (6) and/or cover plate (7) and are constructed to receive articles in the form of articles of daily use (9) and/or consumer articles and are also accessible from the outside via storage openings (23), and the storage openings (23) are arranged in at least one of the longitudinal side faces (4) and/or transverse side faces (5) preferably running perpendicular to the base plate (6) and/or cover plate (7).

16 Claims, 26 Drawing Sheets

CARD-SHAPED STORAGE CASE FOR ARTICLES OF DAILY USE AND/OR CONSUMER ARTICLES

CROSS-REFERENCE TO RELATED APPLICATION

This application is a continuation of application Ser. No. 09/851,783, filed Jun. 22, 2001, now U.S. Pat. No. 6,527,112 which is a continuation of application Ser. No. 09/460,268, filed on Dec. 13, 1999, now U.S. Pat. No. 6,257,405, which is a division of application Ser. No. 09/077,482, filed on May 29, 1998, now U.S. Pat. No. 6,044,967, which is a national phase entry under 35 U.S.C. § 371 of PCT/AT96/00238, filed on Dec. 2, 1996.

FIELD OF THE INVENTION

The invention relates to a card-shaped storage case made of metal or plastic.

BACKGROUND OF THE INVENTION

A card-shaped storage case made of plastic is already known which is equipped with several storage compartments to receive various articles of daily use, such as knives or files, for example, whereby handles connected to the individual articles of use project above the external dimensions of this storage case. When articles of use are inserted into the storage case, the dimensions of this transport means for the articles correspond essentially to the main dimensions of a cheque card. The disadvantage here is that when the storage case is removed. for example, from a storage pocket for a cheque card in a wallet, the individual articles of use become detached from the storage case and therefore removal as well as insertion of the storage case into such a storage pocket is practically impossible.

A card-shaped storage case made of plastic, in particular for credit and check cards, is additionally known, which preferably has a rectangular outline as well as a storage compartment, which is defined by a base plate, a cover plate running parallel to this, and also side walls, which run perpendicular to the base plate or cover plate. A storage opening is located in one of the side walls through which the credit card or check card is inserted into the storage compartment. The advantageous small external dimensions of such storage cases, in particular their small thickness, permit these storage cases to be accommodated in an extremely small space, as is necessary, for example, for insertion into a wallet. However, this advantage can only be utilized for an article to be inserted into the storage case, e.g. for a credit or cheque card.

SUMMARY OF THE INVENTION

The present invention provides a card-shaped storage case which permits a secure hold of the articles in the storage case while retaining the advantageous small external dimensions and the resulting low space requirement for storage.

According to one embodiment of the present invention, articles are arranged next to one another in a storage case, as a consequence of which a small thickness of the external dimensions may be retained. The invention provides a storage case by means of which the articles can be removed or inserted into the storage case easily and rapidly.

In accordance with the invention, simple production of the storage case is assured while at the same time enabling easy accessibility of the article arranged in the storage case.

A further development in accordance with the invention is also advantageous, in which the accessibility of article arranged in the storage case, in particular very flat articles is facilitated.

Other embodiments of the invention have the advantage that the articles of daily use or consumer articles may have different thicknesses and a minimum wall thickness of the storage case is nevertheless maintained, and therefore greater rigidity of the storage case is achieved.

Further developments may be provided to render articles of daily use and/or consumer articles of larger size arranged in the storage case accessible by way of a simply executed swivel movement or sliding ability of a swivel plate.

Moreover, further embodiments, are also of advantage, as a result of which the articles of daily use and/or consumer articles are prevented from becoming detached from or sliding out of the storage compartments of their own accord.

The invention provides yet another embodiment as a result of which an extremely flat structural shape of the storage case may be assured. In addition, the storage case may be inserted into or removed from conventional storage pockets, such as those provided in particular in document cases, wallets, or personal organizer folders.

Alternative embodiments provide even better access to the articles of daily use and/or consumer articles and with which a frictional engagement can increase the hold of the articles of daily use and/or consumer articles in the storage compartments.

A further development is also possible, as a result of which production of the storage case may be easily carried out and thus manufacturing costs, in particular for the production of injection molding tools, may be reduced.

An alternative embodiment allows all the storage compartments to be arranged solely in the base plate or the cover plate.

A further development allows the storage case to be adapted to a wide variety of articles of daily use and/or consumer articles in a simple manner and at low expenditure, whereby rigidity of the storage case is increased.

Moreover, a simply manipulated cover may be provided without there being any sharp points or projecting parts on the storage case which would prevent it from being inserted into storage pockets, e.g., in wallets.

A cover may be provided such that on the one hand the cover is prevented from detaching itself independently and on the other hand a covering area can be fully exposed by the cover.

An alternative embodiment is also of advantage, which embodiment enables the swivel plate itself to be held in position in the storage case and/or at the same time allows sharp or pointed articles of daily use, which must be secured against independent detachment for safety reasons, to be held in position.

Certain embodiments have the advantage that the articles of daily use or consumer articles necessary for the most frequent usages can be arranged in the storage case.

The storage cases of some embodiments of the invention may allow insertion in storage pockets such as those provided in wallets, document cases or personal organisers, for example, by appropriate variation of the thicknesses, even in the case of different external dimensions, without these storage pockets being overstretched, which would cause the storage case to unintentionally slide out of the storage pockets.

Further embodiments include a graduation or linear measure, whereby the purpose of such a storage case is positively extended so that various measuring tasks may also be performed.

Because of standardized dimensions, the storage case may be inserted into or removed from a wide variety of wallets, document cases or personal organisers.

In one embodiment, a simple insertion is possible even with a slight canting of the article.

In some embodiments, the recesses are arranged respectively partly in the base plate and the cover plate.

An embodiment is also of advantage, in which thin webs can be used which form a plurality of ribs between the cover plate and the base plate so that a very stable structure of the card-shaped storage case can be obtained even with extremely thin walls for the base plate and cover plate. In addition, the manufacture from plastic in the injection moulding process is simplified, as thinner webs or webs with thin walls can be produced, which with such a thin component can be more easily filled with the plasticised plastic and with several parallel thin webs a honeycomb-like more stable structure can be obtained than with few webs with thick walls.

By the arrangement of connecting webs according to a further embodiment, the regions in which the base plate and the cover plate are actually connected can be predefined.

A further design favours the production of the connection between the base plate and the cover plate by means of welding, for example ultrasonic welding.

In accordance with another embodiment of the invention, the flexibility of the base plate and cover plate in a direction perpendicular to their upper or lower side can be adjusted easily depending on the distance between the individual connecting webs to meet different requirements, so that a corresponding amount of space is obtained on inserting and locking articles of daily use or consumer articles.

Lastly, a design is advantageous, in which defined connecting regions may be formed between the base plate and the cover plate.

BRIEF DESCRIPTION OF THE DRAWINGS

For a better understanding of the invention, the latter is explained below by way of the embodiments shown in the drawings.

Shown are.

DETAILED DESCRIPTION

Figure 1:
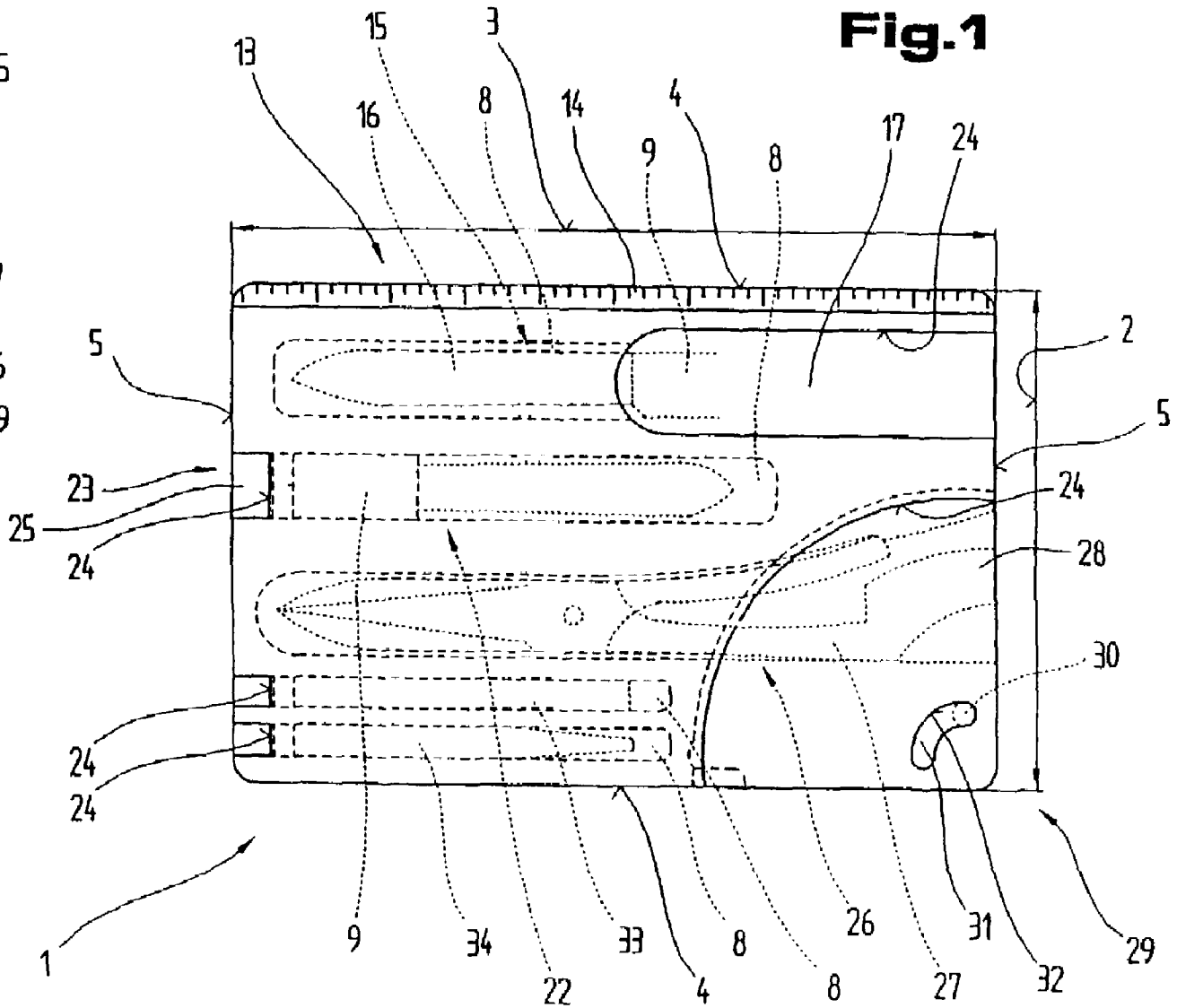
FIG. 1 a plan view of a storage case according to the invention with inserted articles of daily use.
Figure 2:
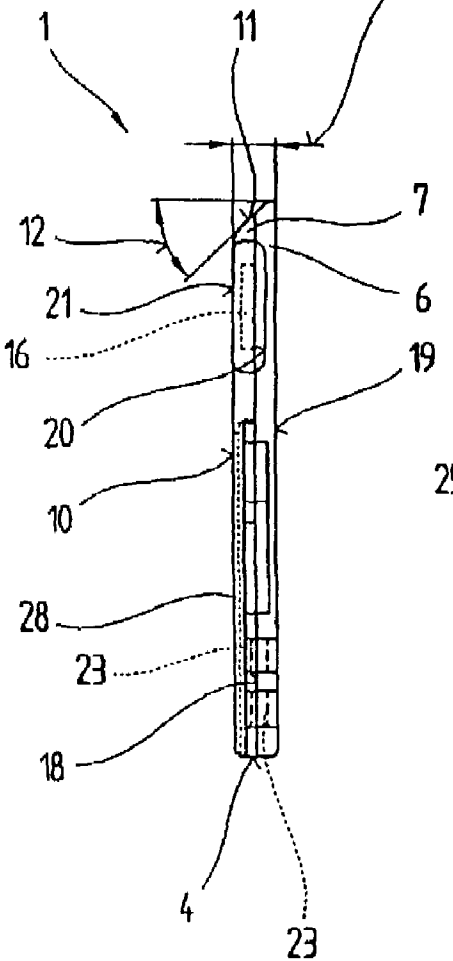
FIG. 2 a side view of the storage case according to the invention.

In the jointly described FIGS. 1 and 2 a card-shaped storage case 1 made of metal or plastic is shown, which has a rectangular outline with a width 2 and a length 3 measured at right angles to this. The width 2 separates two longitudinal side faces 4 running parallel to one another and running perpendicular to transverse side faces 5 spaced from one another by the length 3. The card-shaped storage case I has a base plate 6 and a cover plate 7, which are connected detachably or non-detachably to one another. In addition, the longitudinal side faces 4 and transverse side faces 5 preferably run perpendicular to the base plate 6 and to the cover plate 7. From the transverse side faces 5 located Opposite one another internal storage compartments 8 extend, in which articles, in particular articles of daily use, but also consumer articles are arranged.

A longitudinal side face 4 is connected to a top side 10 of the cover plate 7 running perpendicular thereto via an inclined surface 11, which runs on an incline at an angle of inclination 12 from the longitudinal side face 4 in the direction of the top side 10 and the second longitudinal side face 4. However, it is also possible that the second longitudinal side face 4 and/or the transverse side faces 5, or at least parts of the longitudinal side faces 4 or transverse side faces 5, are arranged on an incline to the base and/or cover plate 6 and 7 respectively and form the inclined surface 11. In this case, the inclined surface 11, or an area of the base plate 6 and or the cover plate 7 allocated to this, is provided with a graduation 13, in particular a linear measure 14. The storage compartment 8 for a knife 15 forming the article of use 9 extends adjacent to the inclined surface 11, in which case a knife blade 16 is enclosed by the base plate 6 and the cover plate 7 in a direction perpendicular to the top side 10. However, a knife handle 17 is arranged in a recess groove 20 which projects above a surface 18 connecting the base plate 6 to the cover plate 7 in the direction of a bottom side 19 of the base plate 6 facing away from the top side 10 and running parallel to this, and is therefore only defined by the base plate 6 in the direction of the bottom side 19. Therefore, the storage compartment 8 for the article of daily use 9, i.e. for the knife 15, is enclosed by the base plate 6 and at least in sections by the cover plate 7 running parallel thereto. The knife handle 17 has a grip surface 21 which runs approximately parallel and on a level with the top side 10.

A further storage compartment 8, for example, for a file 22, is arranged adjacent to the knife 15 and in the opposite direction to the graduation 13. This is defined by the cover plate 6 and the base plate 6 in the direction of the top side 10 and the bottom side 19, and a storage opening 23 for the file 22, through which this may be inserted into the storage compartment 8, is arranged in the transverse side face 5. The cover plate 7 has a rectangular recess 24, which projects from the transverse side face 5 in the direction of the transverse side face 5 facing away from this, and in which a file handle 25 is arranged so as to be accessible from the outside via the recess 24. This enables simple handling of the file 22 and thus allows it to be easily inserted into and removed from the storage compartment 8. As a result, a part area of the storage compartment 8 is rendered accessible via the recess 24, such as is also provided to receive the knife handle 17 and which may also be provided in the base plate 6.

Adjacent to the storage compartment 8 for the file 22 extends the storage compartment 8 for a pair of scissors 26 which extends from the transverse side face 5 in the direction of the transverse side face 5 facing away from this. A grip 27 for the scissors 26 and a recess 24 running in a circular arc shape in the cover plate 7 is covered by a swivel plate 28 in the direction of the top side 10, the storage opening 23 for the scissors 26 being defined by the base plate 6 and the cover plate 7 in the direction of the bottom side 19 and the top side 10. The swivel plate 28 is in this case mounted in a swivel mount 31 in a corner area 29 of the storage case 1 by means of a preferably cylindrical swivel pin 30 running perpendicular to the top side 10 or bottom side 19. The swivel mount is constructed as a curved guide slot 32, for example. The swivel pin 30 can be secured against axial movement in the swivel mount 31 by means of a retaining ring.

Adjacent to the storage compartment 8 for the scissors 26, two storage compartments 8 serving to receive a pair of tweezers 33 and a toothpick 34 run parallel to one another and to the longitudinal side face 4. The latter may be inserted into the storage compartments 8 through a respective storage opening 23 in the transverse side face 5. It is also possible to construct the recess 24, such as that provided for the file handle 25, for the handle of the tweezers 33 as well as for the toothpick 34 in the area of the transverse side face 5. The top side 10 is spaced from the bottom side 19 by a thickness 35 of the preferably rectangular storage case 1 and amounts to between 1.5 mm and 5 mm, preferably 4.0 to 4.3 mm. The length 3 must not be smaller than 70 mm and not larger than 90 mm and, like the width 2, forms a multiple of the thickness 35 of the storage case 1, thus enabling it to be accommodated in conventional storage pockets, such as those provided in wallets, document cases or personal organisers, for example. Moreover, practice has shown that the thickness 35 of the storage case I is reduced as the length 3 increases, in which case the thickness 35 of the storage case I is reduced according to the ratio thickness 35 (D) is smaller or equal to [1/18 times (70−length 3)+5]. It is possible to arrange all the storage openings 23 of the storage compartments 8 on a transverse side face 5 or longitudinal side face 4. However, it is more advantageous to arrange the storage openings 23, for example, for the scissors 25 and knife 15 on a transverse side face 5 and the storage openings 23 for the file 22, tweezers 33 and toothpick 34 on the transverse side face 5 facing away therefrom.

A plane of symmetry of the article of daily use 9 and/or the consumer article and/or the storage compartment 8 running parallel to the base plate 6 and/or cover plate 7 is displaced relative to a plane of symmetry of the storage case I running parallel to the base plate 6 and/or cover plate 7 and bisecting the thickness 35 perpendicular to the base plate 6 and/or cover plate 7. Moreover, the swivel plate 28 or a part of the base plate 6 and/or cover plate 7 may be constructed so that it does not swivel, but is displaceable relatively in relation to at least one storage compartment 8 and/or is mounted to be displaceable or to swivel in a plane receiving the base plate 6 and/or cover plate 7. Moreover, a cross-sectional dimension of at least one part of a storage compartment 8 may be adapted with low tolerance to a cross-sectional dimension of the article of daily use 9 and/or the consumer article, which in addition may also be held by way of frictional engagement in the storage compartment 8. In this case, a roughened surface of the storage compartment 8 and/or the article of daily use 9 and/or consumer article may have a greater surface roughness in a holding area which may enclose the entire storage compartment 8.

A circumferential face edge of the article of daily use 9 and/or consumer article defining the outer contour thereof is aligned approximately perpendicular to the base plate 6 and/or cover plate 7. The article of daily use 9 and/or consumer article has a handle part, such as the handle 25 of the file 22, for example, which projects over its outer periphery and is arranged in the recess 24 and may likewise be secured in the recess 24 by means of frictional engagement. As already stated, the storage case 1 is constructed in two parts, in which case the base plate 6 and/or cover plate 7 may be formed by a single-part plane blank. However, it is also possible to secure the cover plate 7 and the base plate 6 at a distance from one another by way of a central part, which above all defines the storage compartments 8, and to connect them via a connecting means, in particular an adhesive or weld joint. In the region of a curved face the swivel plate 28 can have a locking projection projecting above this which engages into a locking recess of an article of daily use 9, e.g. scissors 25, and secures the latter from detaching of its own accord. The storage case 1 can, of course, be constructed as a component in a single piece, e.g. as an injection moulded part, in which case the storage compartments 8 for the articles of daily use 9 and/or consumer articles are moulded by means of mould slides during the injection moulding process.

Figure 3:
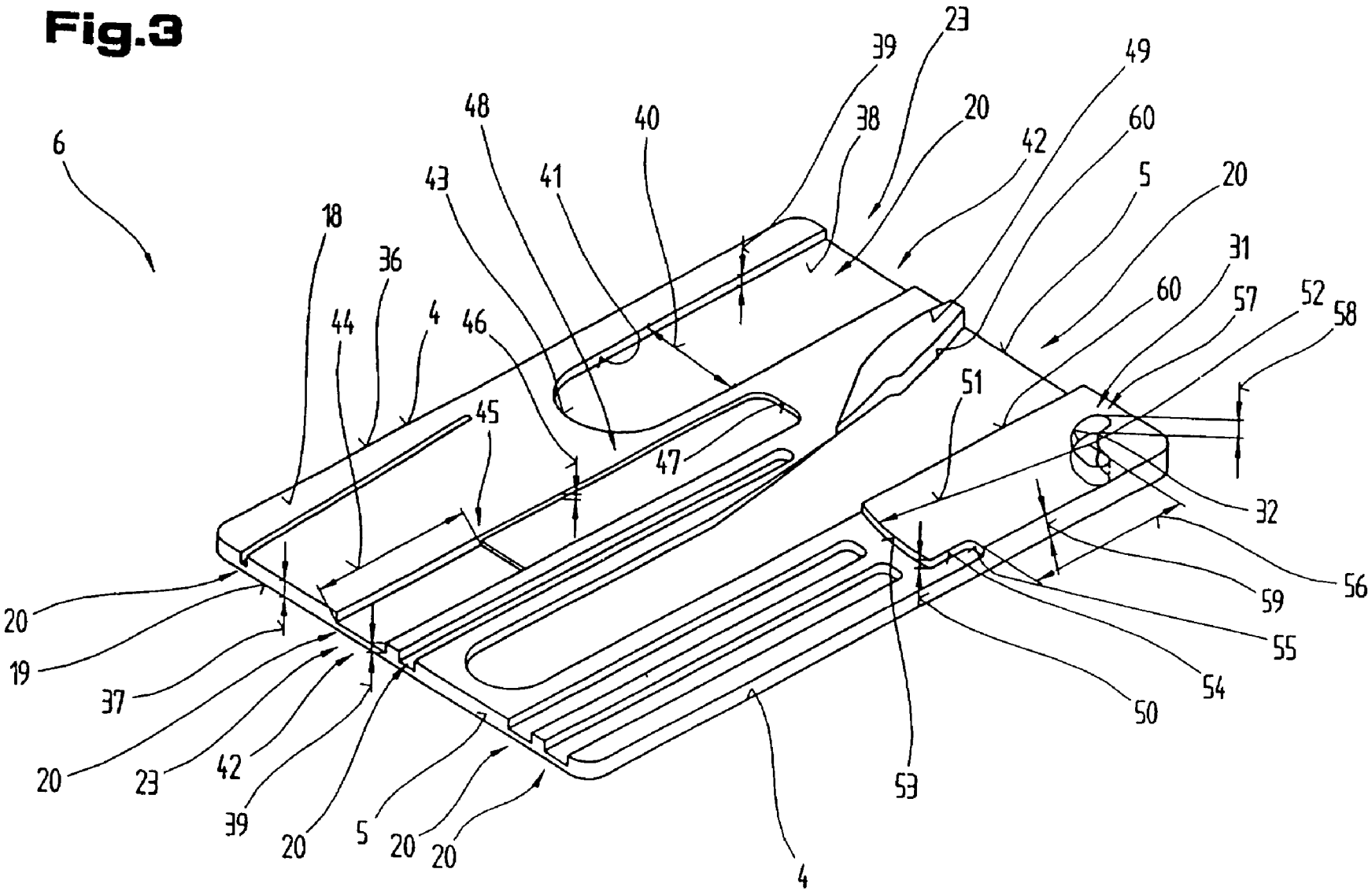
FIG. 3 a perspective view of a base plate of the storage case according to the invention.
Figure 4:
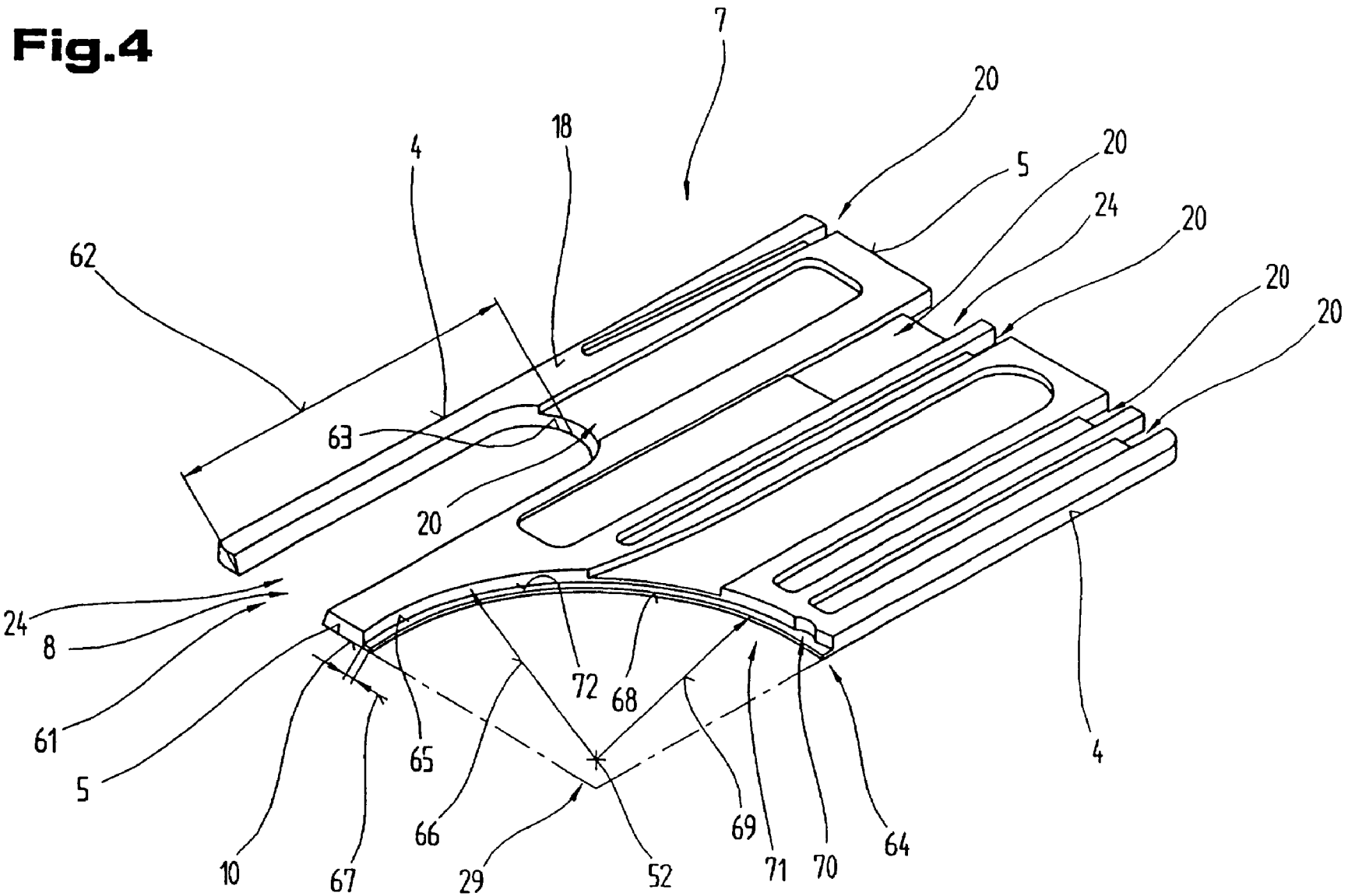
FIG. 4 a perspective view of a cover plate of the storage case according to the invention.

In the jointly described FIGS. 3 and 4 the base plate 6 and the cover plate 7 are shown in a perspective view. The base plate 6 therein has a rectangular circumferential enveloping surface 36 forming the longitudinal side faces 4 and transverse side faces 5, and said enveloping surface defines both the connecting surface 18 and the bottom side 19 spaced from this by a base plate thickness 37. Adjacent to the longitudinal side face 4 facing away from the swivel mount 31, the recess groove 20 is located which has a groove base 38 running parallel to the connecting surface 18 and spaced from the connecting surface 18 by a groove depth 39 in the direction of the bottom side 19. The recess groove 20 serving to receive the knife handle 17 shown in FIG. 1 has a groove width 40 measured at right angles to the longitudinal side face 4 which separates two groove side faces 41 facing one another and running parallel to the longitudinal side faces 4. In the region of the transverse side face 5, the recess groove 20 forms a stepped section 42 which forms a part area of the storage opening 23. In an end region of the recess groove 20 opposite the stepped section 42, a curved surface 43 preferably running in a circular arc shape is arranged which joins the two parallel groove side faces 41 to one another.

The storage opening 23 for the file 22 shown in FIG. 1 is located on the transverse side face 5 opposite the stepped section 42. This opening also has a stepped section 42 and a recess groove 20. The recess groove 20 runs perpendicular to the transverse side face 5 and, in a transverse side face 5 opposite the transverse side face 5 in the direction of this arranged at a distance of a partial length 45, has a shoulder, as a result of which the groove depth 39 in the region of the transverse side face 5 is greater than a partial groove depth 46 of a part section 48 of the recess groove 20 running from the shoulder 45 in the direction of a face 47. A further recess groove 20 serving to receive any other desired article of daily use 9 and/or consumer article extends parallel to this recess groove 20. The recess groove 20 for the scissors 26 shown in FIG. 1 is located in the region of the swivel mount 31. A base surface 49 arranged parallel to the connecting surface 18 runs in this region which projects above the connecting surface 18 in the opposite direction to the bottom side 19 by a height 50. The base surface 49 is defined by a guide surface 53 running perpendicular to this and to the connecting surface 8 in a radius SI around a central point 52.

In the region of a longitudinal side face 4 adjacent to the swivel mount 31, the guide surface 53 has a stop face 54 running parallel to this which has an end face 55 running parallel to the transverse side face 5 and spaced from the central point 52 by a distance 56, which is smaller than the radius 51 and measured parallel to the longitudinal side face 4. The central point 52 here is located on a curved centre line 57 of the swivel mount 31, which forms a curved guide slot 32 for the swivel pin 30—as shown in FIG. 1—and has a slot depth 58 measured perpendicular to the base surface 49 in the direction of the bottom side 19 which is less than a base height 59 defined by the base surface 49 and the bottom side 19. However, it is also possible to construct the swivel mount 31 in the form of a cylindrical blind hole.

The recess groove 20 for the scissors 25 shown in FIG. 1 has two facing flank faces 60, which do not run parallel to the longitudinal side faces 4, but are formed to match the external shape of the scissors 26. Two recess grooves 20 for the tweezers 33 and toothpick 34 shown in FIG. 1 running parallel to one another and to the longitudinal side face 4 are located on the transverse side face 5 facing away from the swivel mount 31 between the recess groove 20 for the scissors 26 and the longitudinal side face 4 located adjacent to the swivel mount 31.

The cover plate 7 has a slot-like opening 61 running parallel to the longitudinal side face 4 which projects from the transverse side face 5 in the direction of the transverse side face 5 facing away from this and running parallel to this by an opening depth 62 and forms the recess 24. The slot-like opening 61 here is defined by a circular arc-shaped face 63 which is spaced from the transverse side face 5 by the opening depth 62. The recess groove 20 running parallel to the longitudinal side face 4 extends from the face 63 opposite the slot-like opening 61. The slot-like opening 61 and the recess groove 20 of the cover plate 7 correspond to the recess groove 20 and connecting surface 18 of the base plate 6 and in this case respectively form a part area of the storage compartment 8 for the knife 15 shown in FIG. 1, in which case the recess groove 20 of the cover plate 7 with the connecting surface 18 forms the part area of the storage compartment 8 necessary for the knife blade 16 and the slot-like opening 61 together with the recess groove 20 of the base plate 6 forms the part area of the storage compartment 8 necessary for the knife handle 17. The slot-like opening 61 therefore passes through both the connecting surface 18 and the top side 10. The transverse side face 5 and the longitudinal side face 4 are connected in the corner area 29 by means of a guide profile 64. This is composed from a guide surface 65 running approximately perpendicular to the connecting surface 18 and extending in a radius of curvature 66 around the central point 52 shown in FIG. 3. In this case, the radius of curvature 66 is larger than the radius 51 of the guide surface 53 of the base plate 6 shown in FIG. 3 by a distance 67. The distance 67 here separates a face 68 running concentrically to the curvature face 65 and running around a face radius 69 around the central point 52 which corresponds approximately to the radius SI of the guide surface 53. In the area where it meets the longitudinal side face 4, the guide surface 65 has a circular arc-shaped recess 70 which projects above the guide surface 65 opposite to the face 68. A guide arrangement 71 is created for the s~vel plate 28 which is formed from the guide surface 53, guide surface 65 as well as a ring face 72, which runs approximately parallel to the connecting surface 18, is arranged in the shape of a circular arc around the central point 52 and is defined by the face 68 and the guide surface 65. The recess grooves 20 for the file 22, tweezers 33, toothpick 34 and a further implement shown in FIG. 1 are shown on the transverse side face 5 opposite the transverse side face 5 with the slot-like opening 61. The recess grooves 20 have the recesses 24 which partially penetrate the top side 10 and serve to provide a better grip on the implements and their handles.

Figure 5:
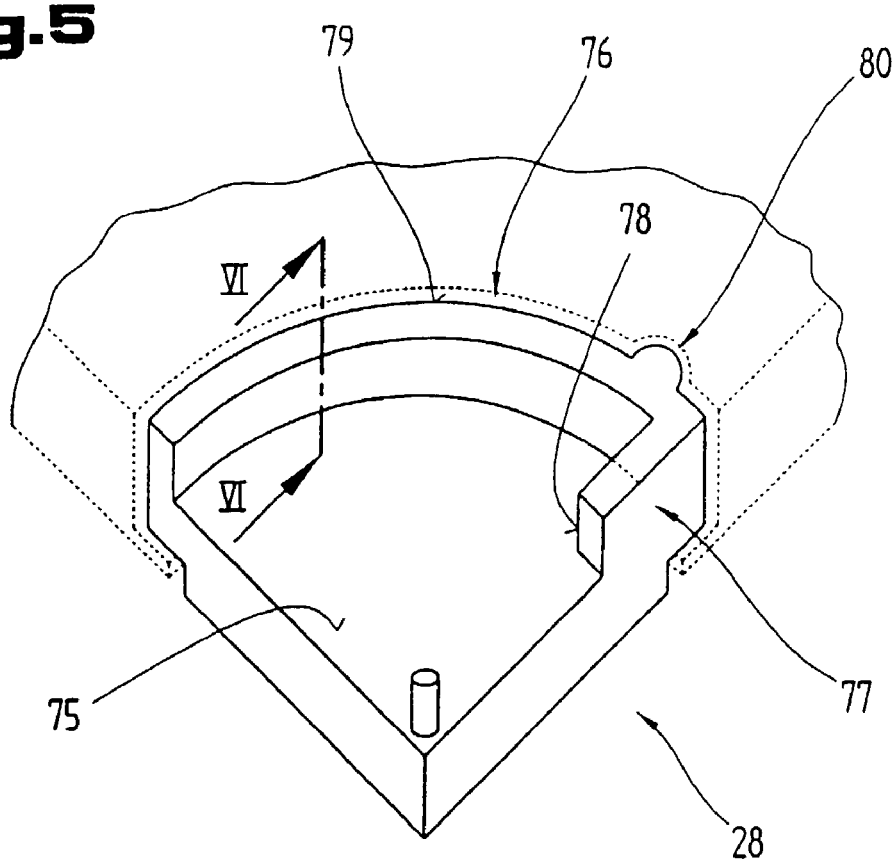
FIG. 5 a perspective view of a swivel plate of the storage case according to the Invention.
Figure 6:
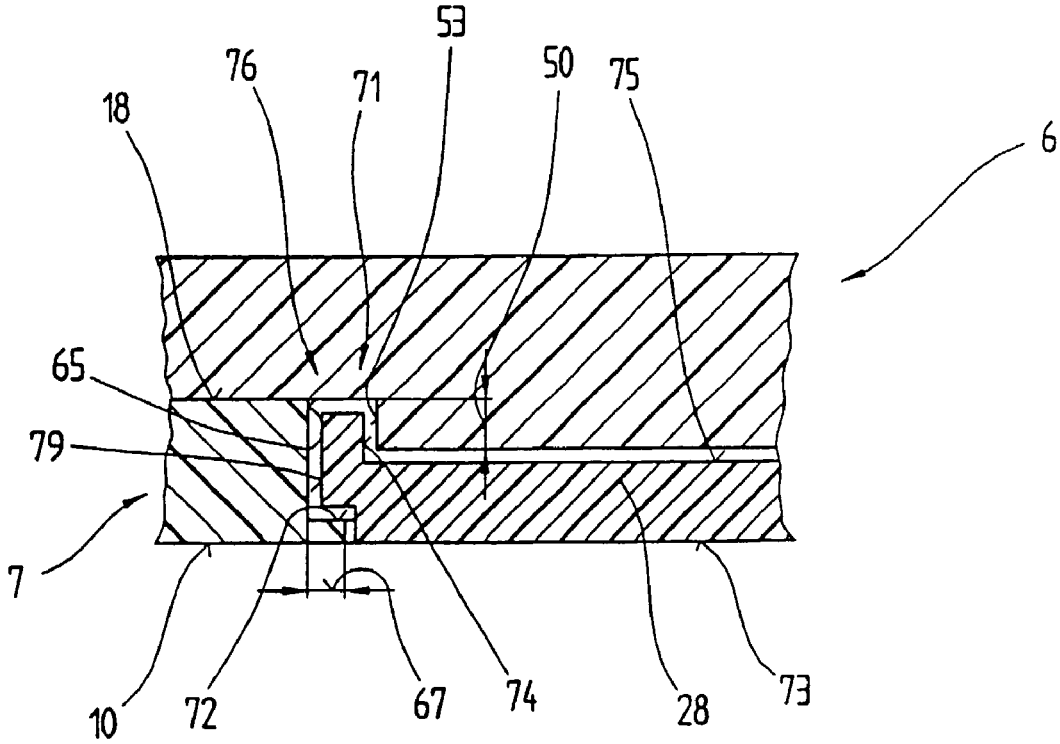
FIG. 6 a sectional view of a part area of the swivel plate, along lines VI-VI of FIG. 5.
Figure 7:
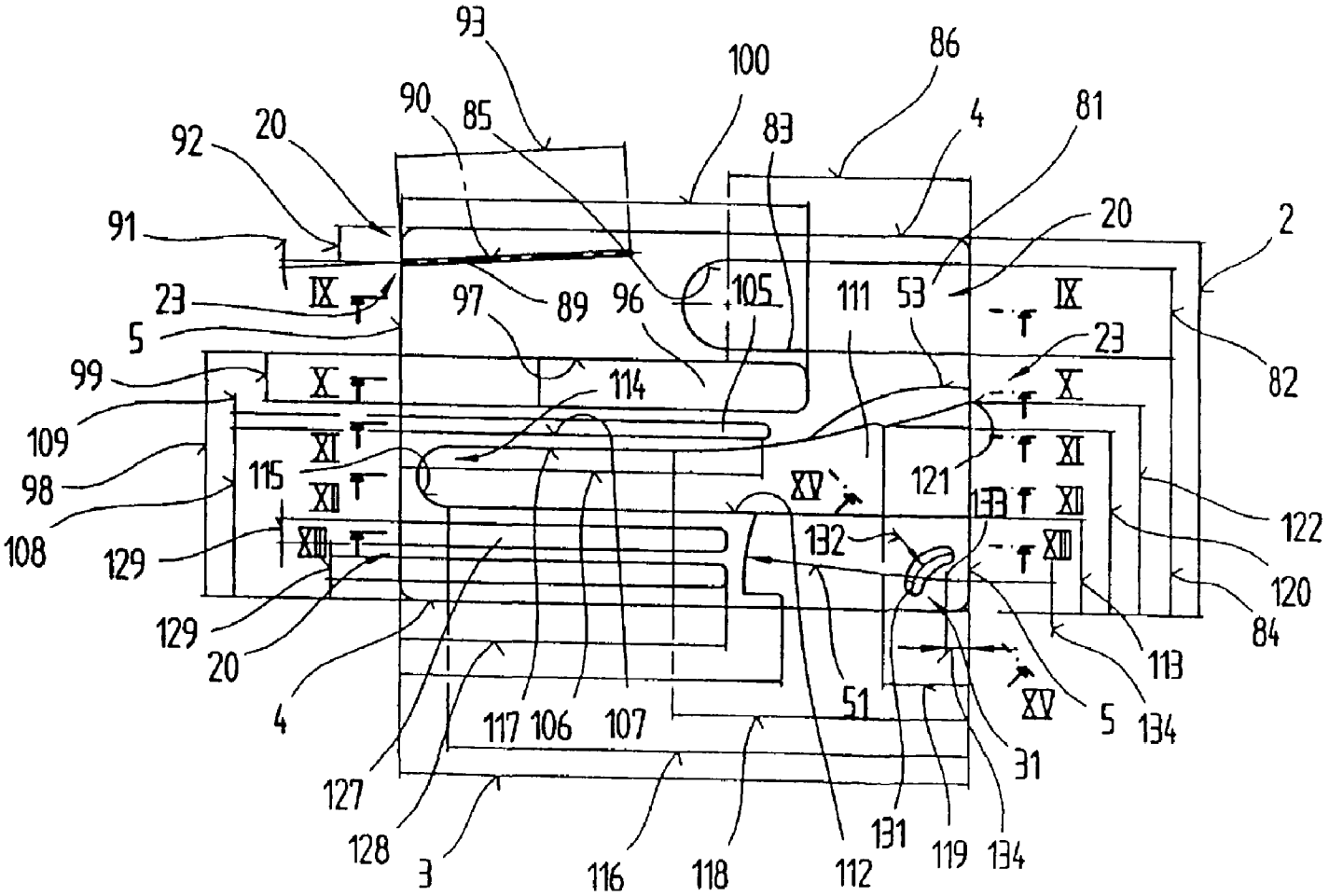
FIG. 7 a plan view of a base plate of the storage case according to the invention.
Figure 8:
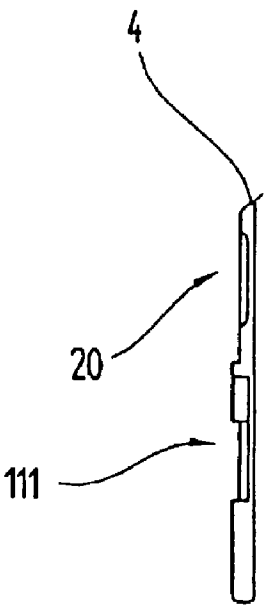
FIG. 8 a side view of the base plate of the storage case according to the invention.

FIGS. 5 and 6 respectively show the swivel plate 28 in a perspective view and a part area thereof in section. They show how the swivel plate 28 is guided in the guide arrangement 71. This is formed by the guide surface 65 and the ring face 72, which are arranged in the cover plate 7, the guide surface 65 running perpendicular to the top side 10 and the ring face 72 running parallel to the top face 10. By distance 67 a covering area of the ring face 72 and a top side 73 of the swivel plate 28 is formed, thus preventing movement of the swivel plate 28 in the direction of the top side 10. The base plate 6 has the already described guide surface 53 which projects above the connecting surface 18 in the direction of the top side 10 of the cover plate 7 by the height SO. It runs along an inner ring face 74 which is arranged perpendicular to an inner side 75 of the support plate 28 running parallel to the top side 73 and projects above this support plate in the direction of the connecting surface 18. As a result of this, a ring-shaped collar 76 is formed which is guided in the guide arrangement 71, whereby movement of the swivel plate 28 in the direction of the base plate 6 is prevented. The collar 76 has a web 77 which forms a stop with an inner face 78 and the stop face 54 shown in FIG. 3. An extension 80 projecting above the outer ring face 79 opposite the collar 76 and forming a stop with the recess 70 shown in FIG. 4 is located in the region of the collar 76 on an outer ring face 79 defining the collar 76 to the outside.

In the jointly described FIGS. 7 to 15 the recess grooves 20 are shown with corresponding dimensions. A knife recess groove 81 forming the recess groove 20 and arranged adjacent to the longitudinal side face 4 has a groove width 82, which is measured parallel to the width 2 and amounts to 12.83 mm. A groove side 83 running parallel to the longitudinal side face 4 is spaced from a longitudinal side face by a distance 84 of 37.3 mm. The width 2 preferably amounts to 54 mm, the length 2 preferably 82 mm. The knife recess groove 81 projects from the transverse side face 5 in the direction of the transverse side face 5 facing away from this by a depth, whereby a face 85 running in a circular shape, which defines the knife recess groove 81 in the direction of the transverse side face 5, preferably runs in the shape of a circular arc and a central point of the face 85 running in a circular arc shape is spaced from the transverse side face S by a distance 86 of 35 mm. A groove base 87 of the knife recess groove 81 running parallel to the connecting surface 18 is spaced from this in the direction of the bottom side 19 by a groove depth 88 of 1 mm.

Figure 14:
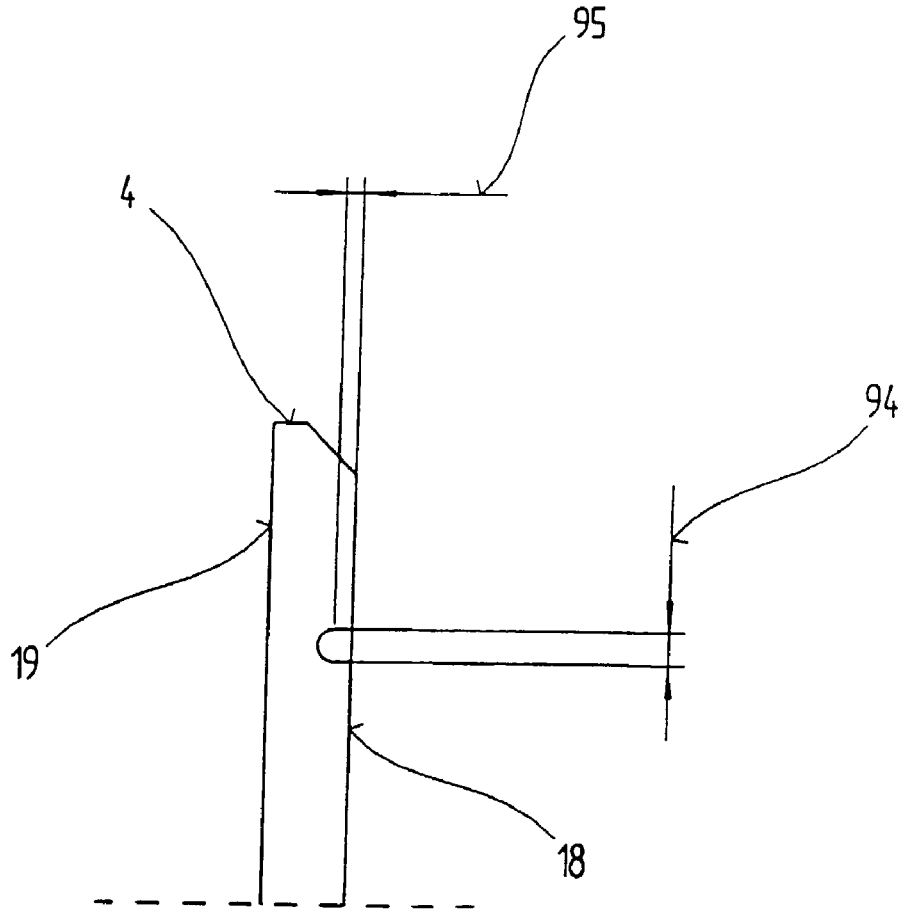
FIG. 14 a side view of a part area of the base plate of the storage case according to the invention.

A further recess groove 20 forms a needle recess groove 89, which extends at an angle from the transverse side face 5 towards the transverse side face 5 facing away from this and the longitudinal side face 4. A centre line 90 of the needle recess groove 89 thus encloses an angle 91 of 350 with an artificial line running perpendicular to the transverse side face 5. The inlet of the needle recess groove 89 located in the region of the transverse side face 5 is spaced from the longitudinal side face 4 by a distance 92 of 5.17 mm, said needle recess groove 89 having a length 93 of 33 mm—as shown in FIG. 14. It additionally has a groove width 94 of 0.8 mm measured perpendicular to the longitudinal side face 4 and has a semi-circular base in its end region facing the bottom side 19, a central point of this semi-circular base being spaced from the connecting surface 18 in the direction of the bottom side 19 by a depth 95 of 0.4 mm.

A file recess groove 96 forming a further recess groove 20 is spaced with a groove side face 97 from the longitudinal side face 4 by a distance 98 of 35.5 mm and has a groove width 99 of 7 mm measured parallel thereto. In addition, it has a groove length 100 of 58.5 mm, which runs from the transverse side face 5 in the direction of the transverse side face 5 facing away from this and which is measured parallel to the longitudinal side face 4. The file recess groove 96—as shown in FIG. 10—has the shoulder 45 at a distance 101 from the transverse side face S in the direction of the transverse side face 5 facing away from this which amounts to 20 mm, whereby in the course of the distance 101 a groove base 102 extends from the connecting surface 18 in the direction of the bottom side 19 by a groove depth 103 of 1.2 mm and has a groove depth 104 of 0.7 mm from the shoulder 45 towards the end region of the file recess groove 96.

Beside the file recess groove 96 a further implement groove 105 is arranged which extends from the transverse side face 5 in the direction of the transverse side face S facing away from this and has a circular arc-shaped end region, the central point of which is spaced from the transverse side face 5 by a groove length 106 from the transverse side face 5 which amounts to 52 mm. A groove side face 107 of the implement groove 105 is spaced from the longitudinal side face 4 by a distance 108 of 24.5 mm and has a groove width 109 of 2.2 mm. In addition, it has a groove depth 110 of 1.1 mm measured from the connecting surface 18 in the direction of the bottom side 19—as shown in FIG. 11.

A scissor recess groove 111 forming another recess groove 20 has a groove side face 112, which runs parallel to the longitudinal side face 4 and is spaced from this by a distance 113 of 13.5 mm from the longitudinal side face 4. A face region 114 of the scissor recess groove Ill has a face 115 running in a circular arc shape, the central point of which is spaced from the transverse side face 5 at a distance 116 of 75 mm. A groove side face 117 extends to face the groove side face 112 and runs from the circular arc-shaped face 115 in the direction of the transverse side face 5 parallel to the groove side face 112, i.e. up to a distance of 118 of 42.59 mm. From this region it widens out in the direction of the transverse side face S and in the area of a distance 119 of 12.52 mm has a distance 120 from the longitudinal side face 4 of 26.67 mm, whereby it widens out further from the distance 120 towards the transverse side face 5 and an end edge 121 of the storage opening 23 is spaced from the longitudinal side face 4 at a distance 122 of 30.43 mm. A groove base 123 of the scissor recess groove 111 is spaced from the connecting face 18 in the direction of the bottom side 19 by a groove depth 124 of 1.2 mm—as shown in FIG. 12. The base surface 49 running parallel to the bottom side 19 is spaced from the bottom side 19 by a base height 59 of 3 mm—as shown in FIG. 13.

Figures 9, 10, 11, 12, 13:
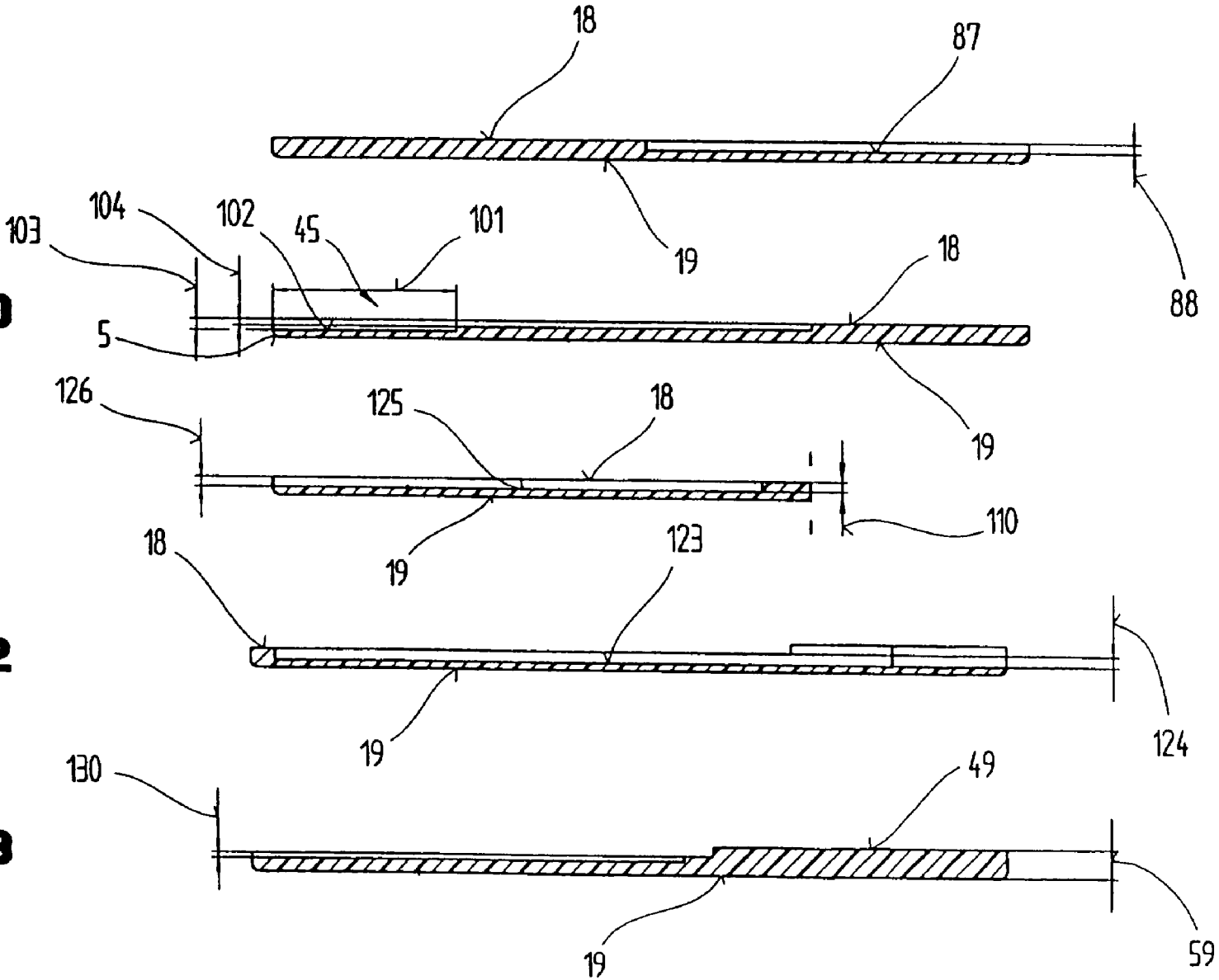
FIG. 9 a sectional view of the base plate of the storage case according to the invention, along lines IX-IX of FIG. 7.
FIG. 10 a sectional view of the base plate of the storage case according to the invention, along lines X-X of FIG. 7.
FIG. 11 a sectional view of the base plate of the storage case according to the invention, along lines XI-XI of FIG. 7.
FIG. 12 a sectional view of the base plate of the storage case according to the invention, along lines XII-XII of FIG. 7.
FIG. 13 a sectional view of the base plate of the storage case according to the invention, along lines XIII-XIII of FIG. 7.
Figure 15:
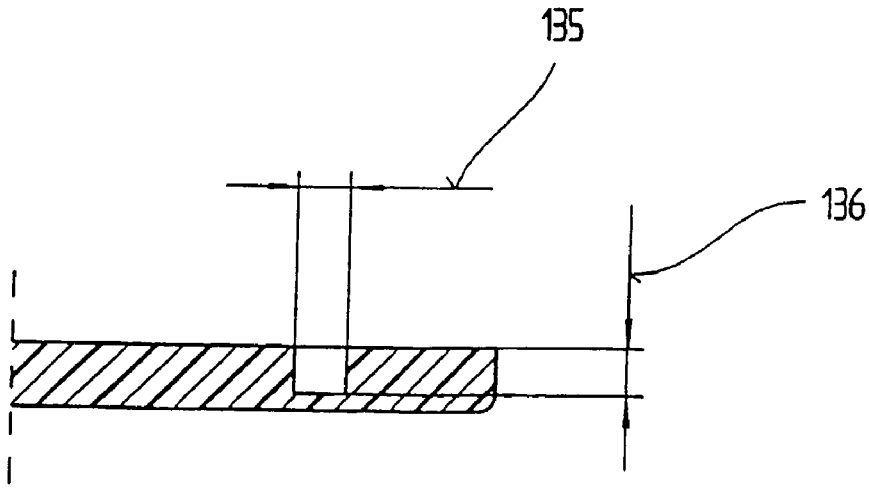
FIG. 15 a sectional view of a part area of the base plate of the storage case according to the invention, along lines XV-XV of FIG. 7.
Figure 17:
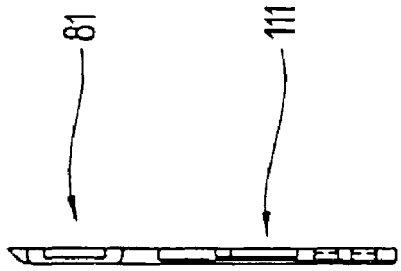
FIG. 17 a side view of the cover plate of the storage case according to the invention.
Figure 16:
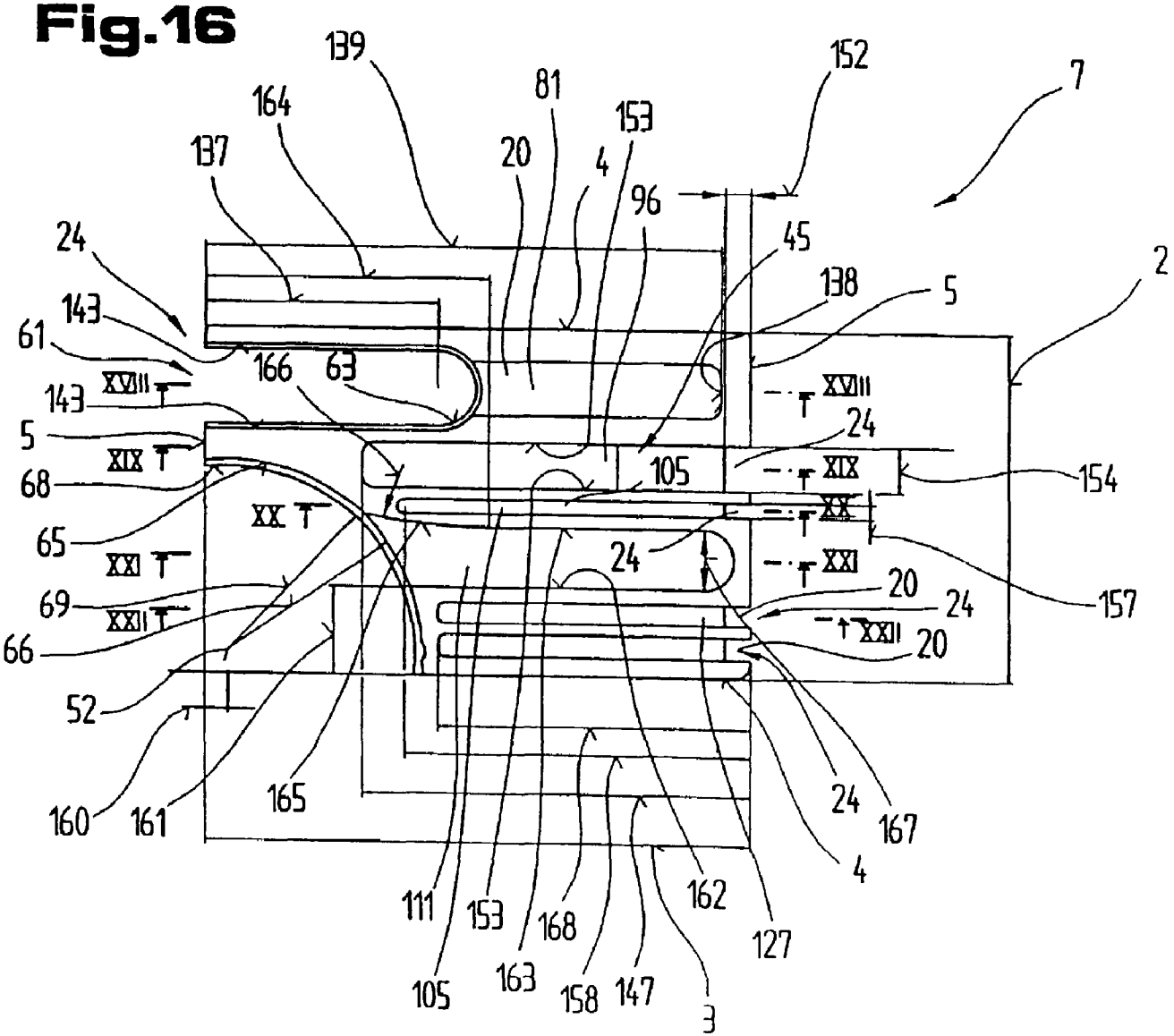
FIG. 16 a plan view of a cover plate of the storage case according to the invention.

In the groove base 125 of the already described implement recess groove 105—as shown in FIG. 11, is spaced from the connecting surface 18 in the direction of the bottom side 19 at a groove depth 126 of 1.1 mm. A tweezers recess groove 127 extends from the transverse side face 5 by a groove length 128 of 47 mm, which is identical to that of the recess groove 20 for the toothpick 34. The groove width ~129 amounts to 3.3 mm and the groove depth 130 amounts to 0.6 mm. The swivel mount 31 is constructed in the form of a curved elongated hole and has a curved centre line 131 which runs around a radius 132 from a central point 133. The central point 133 lies at a distance 134 of 3.5 mm in the direction of the longitudinal side face 4 and transverse side face 5. From these extends the radius 51 which defines the guide surface 53 and amounts to 29 mm. The swivel mount 31 has a groove width 135 of 2.5 mm and a groove depth 136 of 2.2 mm—as shown in FIG. 15.

Figures 18, 19, 20, 21, 22:
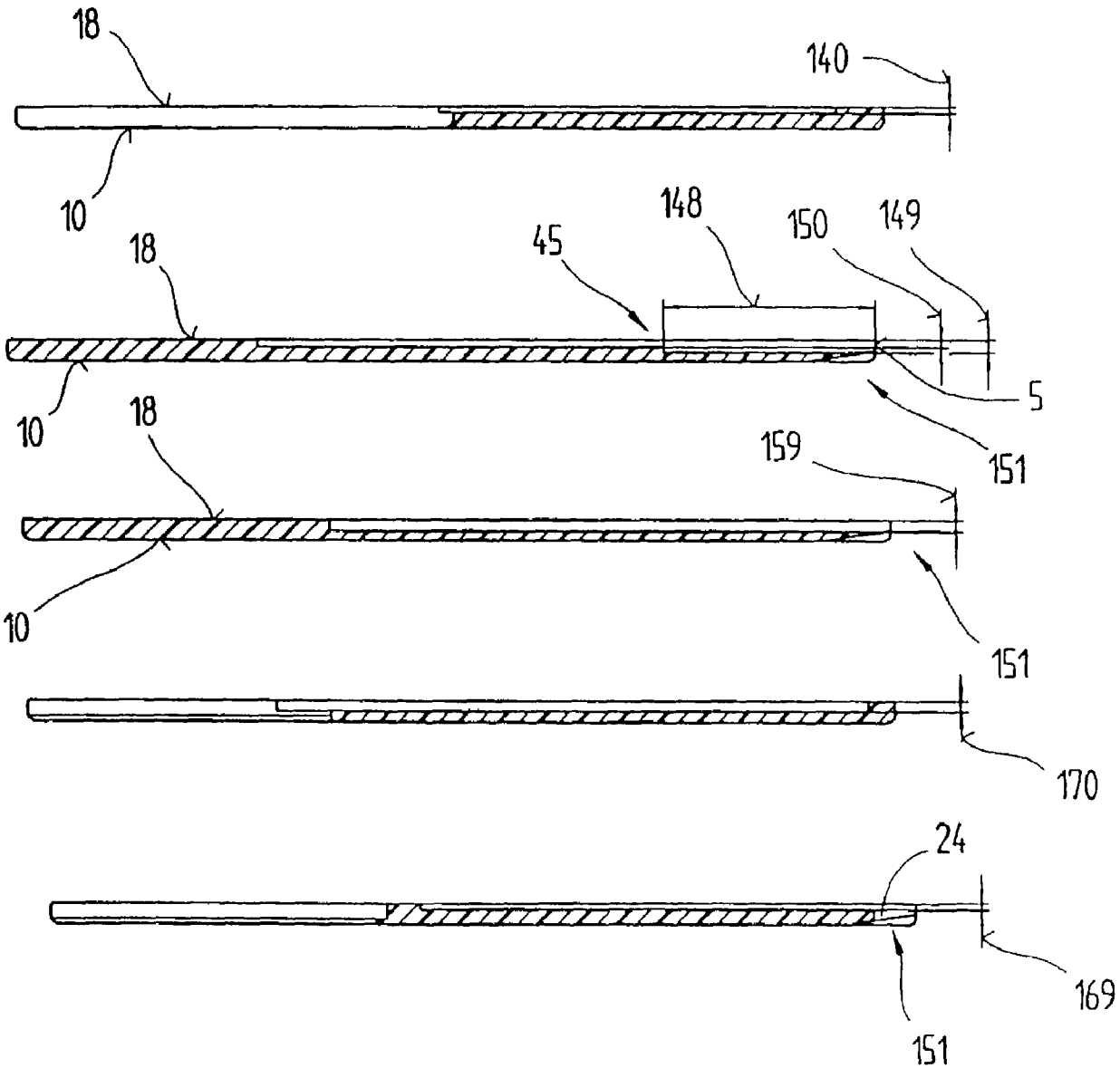
FIG. 18 a sectional view of the cover plate of the storage case according to the invention, along lines XVIII-XVIII of FIG. 16.
FIG. 19 a sectional view of the cover plate of the storage case according to the invention, along lines XIX-XIX of FIG. 16.
FIG. 20 a sectional view of the cover plate of the storage case according to the invention, along lines XX-XX of FIG. 16.
FIG. 21 a sectional view of the cover plate of the storage case according to the invention, along lines XXI-XXI of FIG. 16.
FIG. 22 a sectional view of the cover plate of the storage case according to the invention, along lines XXII-XXII of FIG. 16.
Figure 23:
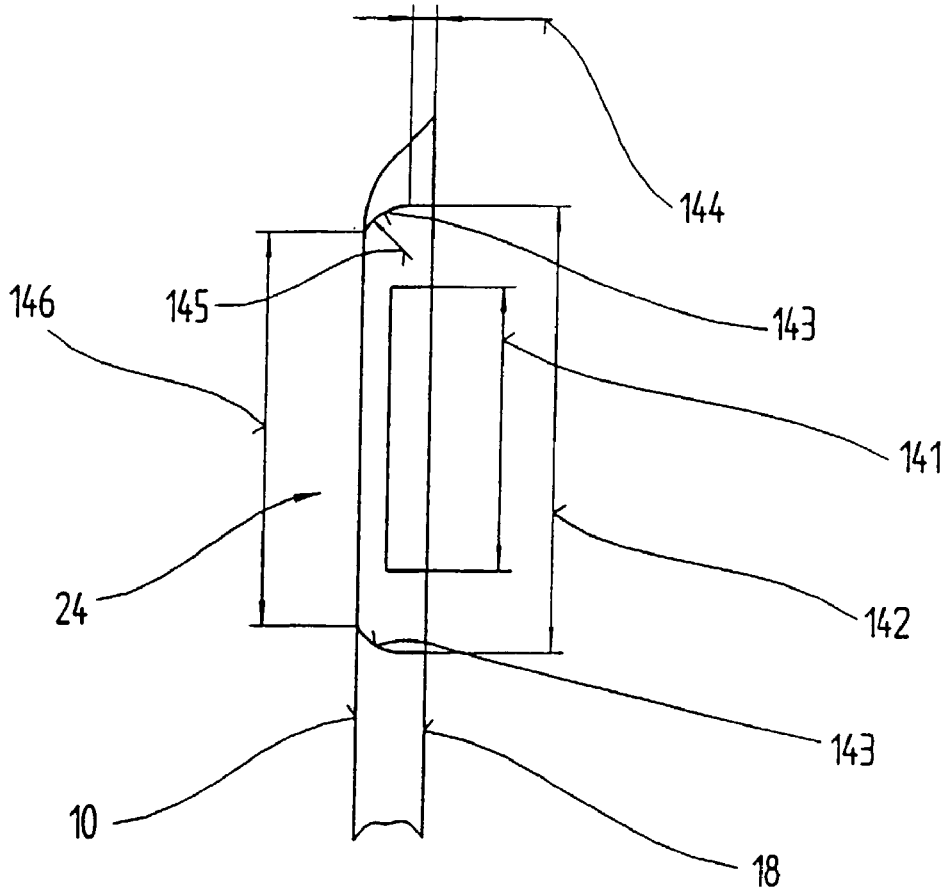
FIG. 23 a side view of a part area of the cover plate of the storage case according to the invention.

In the jointly described FIGS. 16 to 24 the cover plate 7 is shown in detail. As already described the slot-shaped recess 61 herein runs parallel to the longitudinal side face 4, perpendicular to the transverse side face 5, and from the latter runs in the direction of the transverse side face 5 arranged adjacent thereto. The slot-shaped opening 61, which forms the recess 24, has a circular arc-shaped face 63, the central point of which is spaced at a distance 137 of 35 mm from the transverse side face 5. An end face 138 of the recess groove 20 extending from the face 63 in the direction of the transverse side face 5 which forms the knife recess groove 81, in particular for the knife blade 16 shown in FIG. 1, is spaced from the transverse side face 5 at a distance 139 of 77.5 mm. In this case, the knife recess groove 81 has a groove depth 140 of 0.6 mm measured from the connecting surface 18 in the direction of the top side 10. In addition, the knife recess groove 81—as shown in FIG. 23—has a groove width 141 measured parallel to the transverse side face 5 which amounts to 8.3 mm, whereby the recess 24 has a recess width 142 of 13 mm measured parallel to the groove width 141. Two recess side faces 143 running parallel to one another and separated by the recess width 142 run perpendicular to the connecting surface 18, from this run towards the top side 10 and from a depth 144 of 0.7 mm has a rounded portion which runs towards the top side 10 at a radius 145 of 1.5 mm. A width of opening 146 in the region of the top side 10 amounts to about 11.5 mm. The file recess groove 96 runs adjacent to the knife recess groove 81 as far as a groove length 147 of 5&5 mm measured from the transverse side face 5. The file recess groove 96 has the shoulder 45 which—as shown in FIG. 19—is spaced from the transverse side face 5 by a length 148 of 20 mm. In this region, the file recess groove 96 has a groove depth 149 from the connecting surface 18 in the direction of the top side 10 of 1.2 mm and a groove depth 150 which separates the groove base extending from the shoulder 45 towards the end region of the file recess groove 96 from the connecting surface 18 in the direction of the top side 10 and amounts to 0.7 mm.

Figure 24:
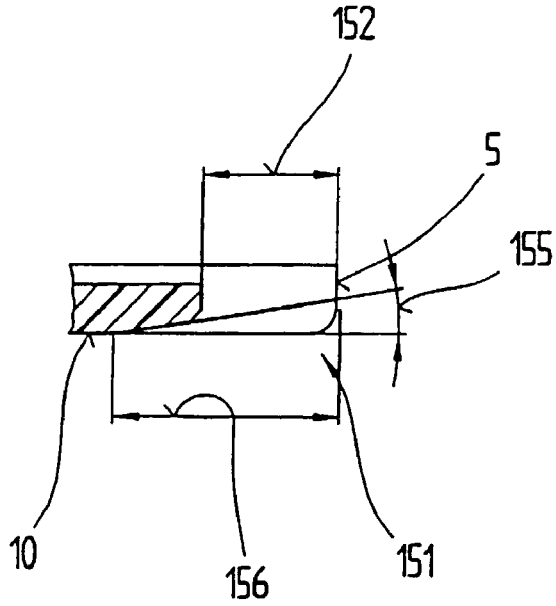
FIG. 24 a sectional view of a part area of the cover plate of the storage case according to the invention.

The top side 10 has a sloping portion 151 in the region of the length 148. The recess 24 of the file recess groove 96 projects from the transverse side face 5 by a depth 152 of 4 mm. Two groove side faces 153 facing one another and running parallel to the longitudinal side face 4 are spaced at a distance 154 of 7 mm. As shown in FIG. 24 the sloping portion 151 runs on an incline at an angle 155 of 3 70 from the transverse side face 5 towards the top side 10 and opens into top side 10 at a length 156 of 6.5 mm. The implement groove 105 is located parallel to the file recess groove 96 and also has the recess 24, which projects from the transverse side face 5 towards the transverse side face 5 facing away from this by a depth 152. The implement groove 105 has a groove width 157 which is measured parallel to the transverse side face 5 and amounts to 2.2 mm. In addition, it projects from the transverse side face 5 towards the transverse side face S facing away from this, whereby it is constructed with a semi-circular shape in an end region and a central point is spaced from the transverse side face 5 at a distance 158 of 52 mm. A groove depth 159 of the implement recess groove 105 from the connecting surface 18 in the direction of the top side 10 amounts to 1.1 mm—as shown in FIG. 20. A sloping portion 151 is likewise provided on the top side 10 in this recess groove 20.

The guide surface 65 running in the shape of a circular arc and extending from the central point 52 in the radius of curvature 66 of 29 mm runs adjacent to the slot-shaped opening 61 from the transverse side face 5. The central point 52 is located at a distance 160 amounting to 3.5 mm from the longitudinal side face 4 and transverse side face 5 respectively. The face 68, which runs concentrically to the guide surface 65, has a face radius 69 which is likewise measured to the central point 52 and amounts to 28 mm.

A groove side face 162 of the scissor recess groove 111, parallel to the longitudinal side face 4, runs from the longitudinal side face 4 perpendicular thereto at a distance 161 of 13.5 mm, whereby a groove side face 163 facing the groove side face 162 runs parallel to the longitudinal side face 4 from an end region of the scissor recess groove Ill to a depth 164 of 42.59 mm measured from the transverse side face 5 in the direction of this end region. From this depth, the groove side face 163 widens out towards the guide surface 65 and has a curvature face 165 which widens the scissor recess groove Ill in a convex shape at a radius 166 of 90 mm. A groove width 167 of the scissor recess groove 111 amounts to 9 mm. Both the tweezers recess groove 167 and the recess groove 20 for the toothpick 34 shown in FIG. 1 run from the transverse side face 5 parallel to the longitudinal side face 4 to a length 168 of 47 mm. The recesses 24 of these two recess grooves 20 are the same as in the embodiments already described, as is the sloping portion 151. A groove depth 169 of these two recess grooves 20 amounts to 0.6 mm. The width 2 of the cover plate 7 amounts approximately to 52.8 mm, the length 3 amounts to about 82 mm. The scissor recess groove 111 has a groove depth 170 of 1 mm.

Figure 25:
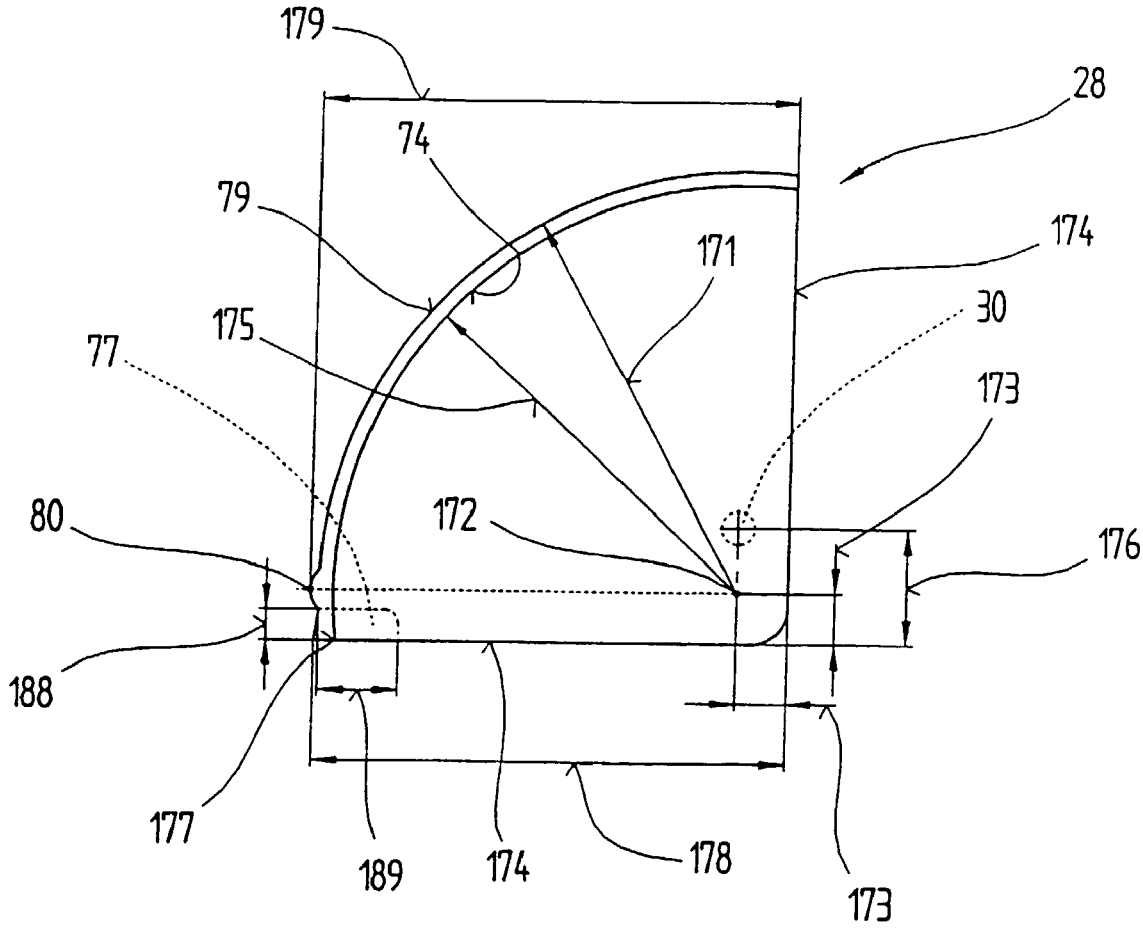
FIG. 25 a plan view of a swivel plate of the storage case according to the invention.
Figure 26:
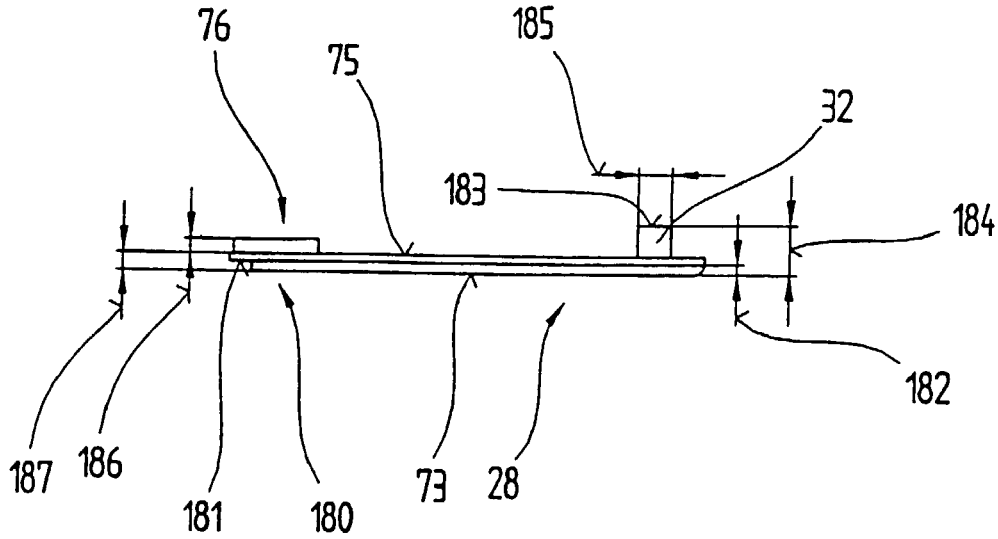
FIG. 26 a side view of the swivel plate of the storage case according to the invention.
Figure 27:
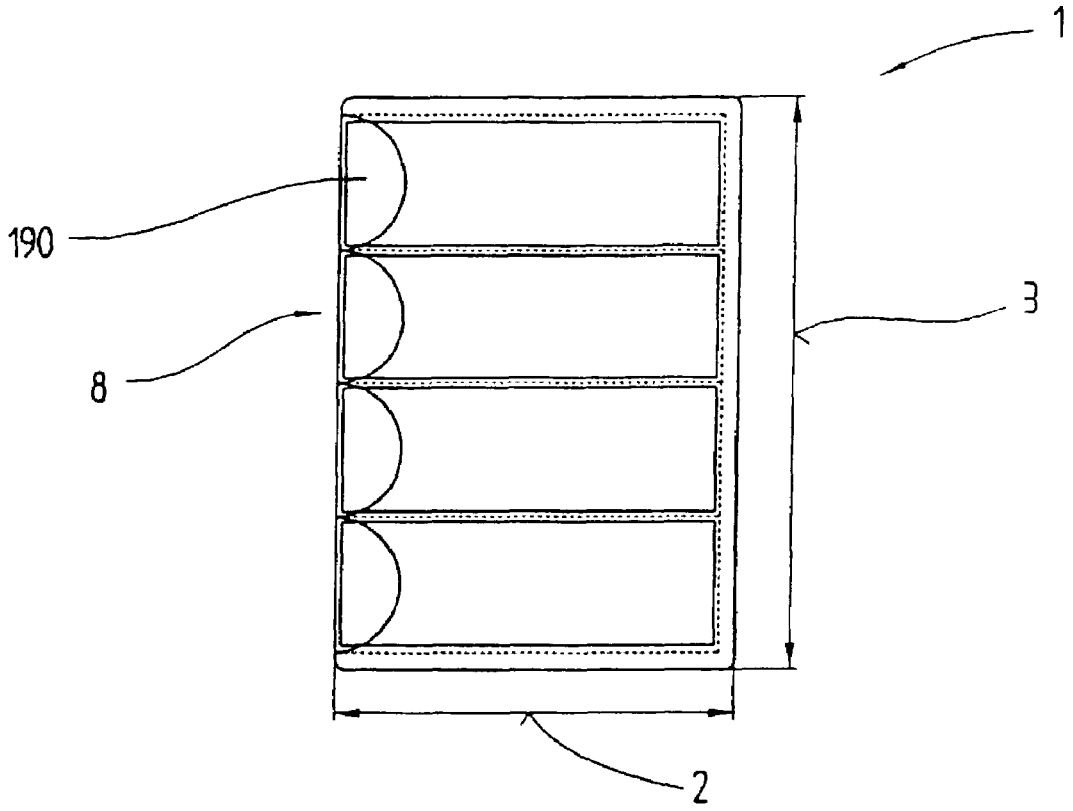
FIG. 27 a plan view of a further embodiment of the storage case according to the invention.

In the jointly described FIGS. 25 and 26 the swivel plate 28 is shown with detailed dimensions marked. The outer ring face 79 runs at a radius 171 of 29 mm around a central point 172. This is arranged at a distance 173 of 3.5 mm from faces 174 running perpendicular to one another. The inside radius 175 spanning the inner ring face 74 is measured from the central point 172. The swivel pin 30 is arranged at an intersection of the distance 173 and a distance 176, which amounts to 8 mm, and lies eccentrically to the central point 172. A distance of an inside edge 177 of the inner ring face 74 from the face 174 amounts to 31.05 mm. An external distance 178 measured parallel to this distance and measured from the face 174 defines the outer ring face 79 and amounts to 32.77 mm. A distance 179, which is measured from the face 174 and parallel to the external distance 178 and defines the outermost point of the extension 80, amounts to about 33.05 mm.

The top side 10 of the swivel plate 28 has a stepped portion 180, through which a ring face 181 running at a depth 182 of 0.7 mm is formed. A surface 183 of the swivel pin 30 is spaced from the top side 73 by a height 184 of about 3.4 mm. The swivel pin 30 has a pin diameter 185 of 2.3 mm. The collar 76 projects above the inner side 75 running parallel to the top side 73 by a height 186 of 1 mm. The top side 73 is spaced from the inner side 75 by a thickness 187 of 1.2 mm. The web 77, which is shown in broken lines, has a web width 188 of 2 mm and projects from the outer ring face 79 towards the face 174 by a length 189 of approximately 5.5 mm. For forms sake, it should be noted that all measurements may, of course, be varied as desired.

In the jointly described FIGS. 27 to 31 further alternative embodiments of the storage case I are shown. In this case, several storage compartments 8, for example, for holding pieces of chewing gum 190, may be spaced from one another in the direction of the length 3. The latter are arranged here parallel to the width 2 of the storage case 1. However, they may also be arranged parallel to the length 3, in which case a region facing away from the storage openings 23 has, for example, a storage compartment 8 for other articles of use 9. In particular, the base plate 6 may, for example, be constructed with a box-shaped central web 191 and be defined by two side webs 192 spaced by the width 2. The side webs 192 each have a shoulder 193 running parallel to the length 3 and projecting in the direction of the bottom side 19 by a shoulder depth 194 from the top side 10, which is defined in this case by the base plate 6. A cover plate 7 in the form of a film, for example, is arranged in this shoulder 193.

Figure 31:
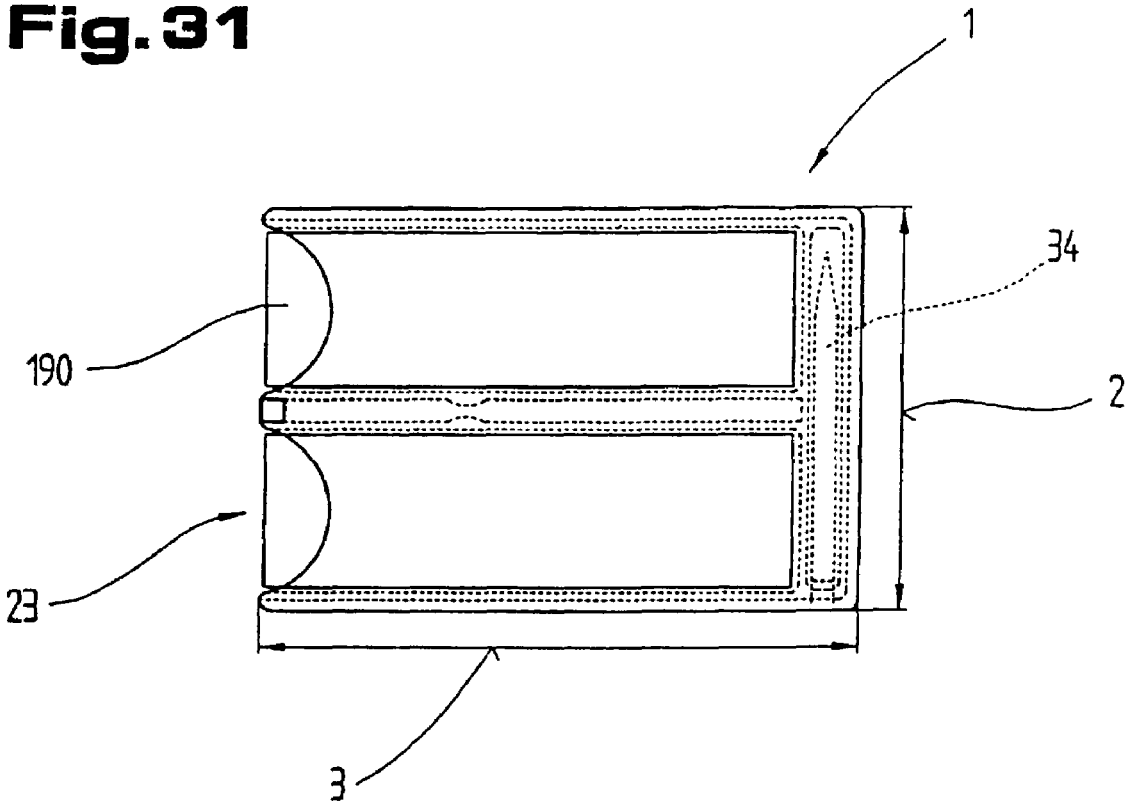
FIG. 31 a plan view of a further embodiment of the storage case according to the invention.
Figure 28:
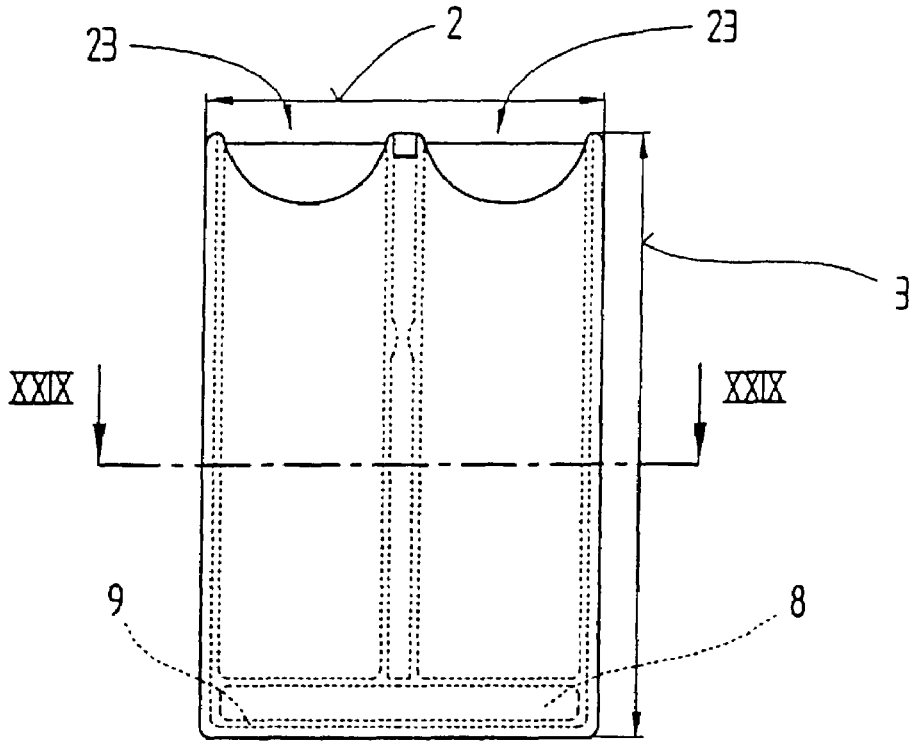
FIG. 28 a plan view of another embodiment of the storage case according to the invention.
Figure 29:
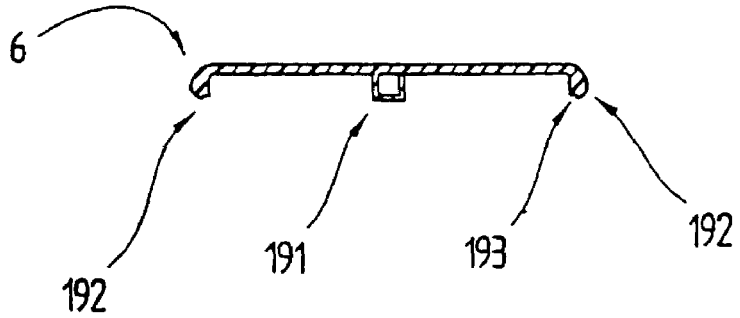
FIG. 29 a sectional view of the storage case according to the invention, along lines XXIX-XXIX of FIG. 28.
Figure 30:
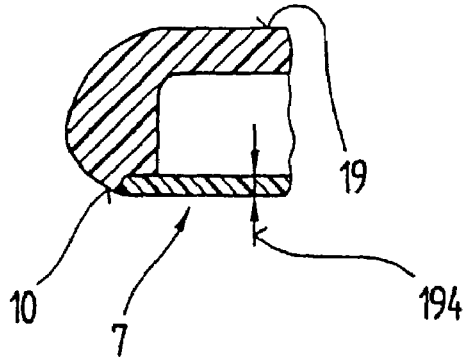
FIG. 30 a part area of the storage case according to the invention.

FIG. 31 shows a further embodiment, in which the pieces of chewing gum 190 are arranged parallel to the length 3, and a toothpick 34 for example running parallel to the width 2 of the storage case 1 is arranged in an end region facing away from the storage openings 23.

Figure 32:
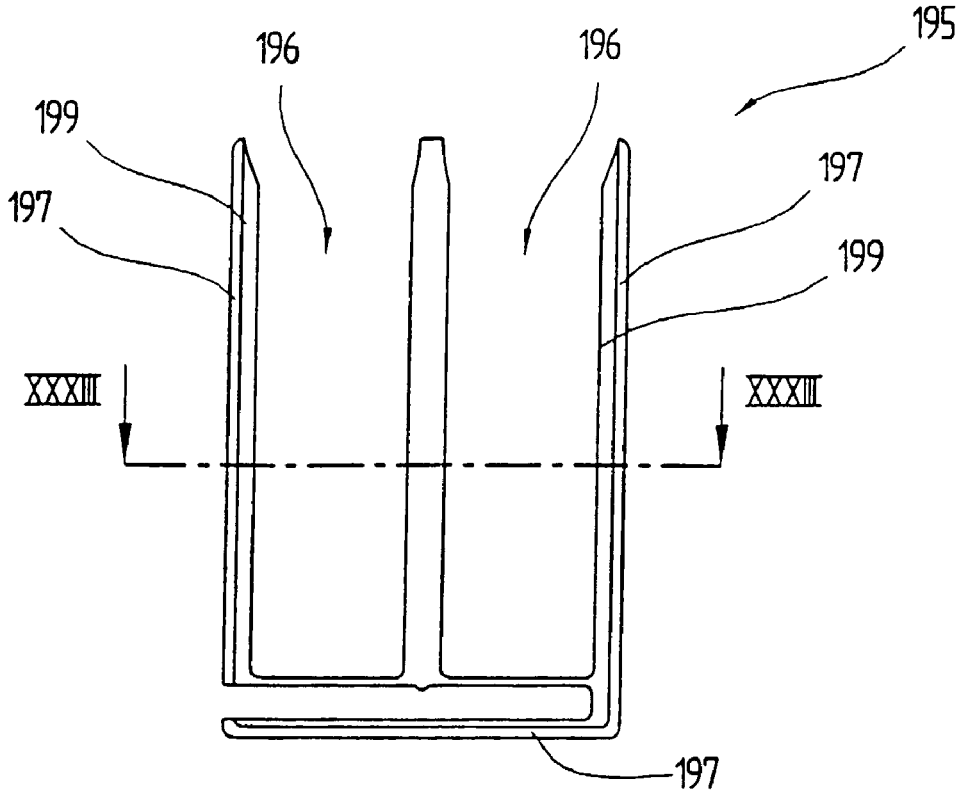
FIG. 32 a plan view of a central part of the storage case according to the invention.
Figure 33:
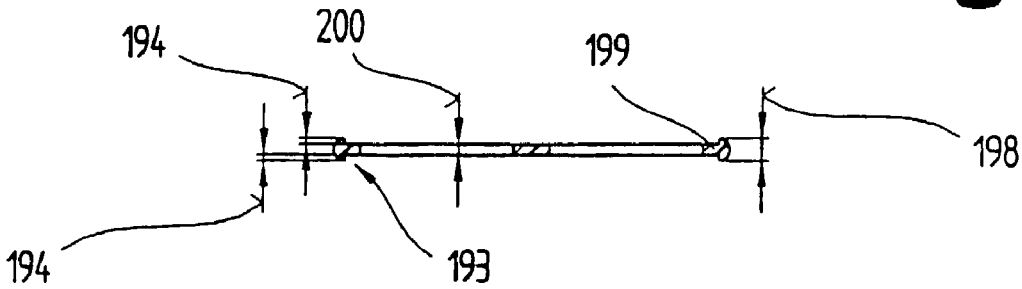
FIG. 33 a sectional view of the central part of the storage case according to the invention, along lines XXXIII-XXXIII of FIG. 32.
Figure 34:
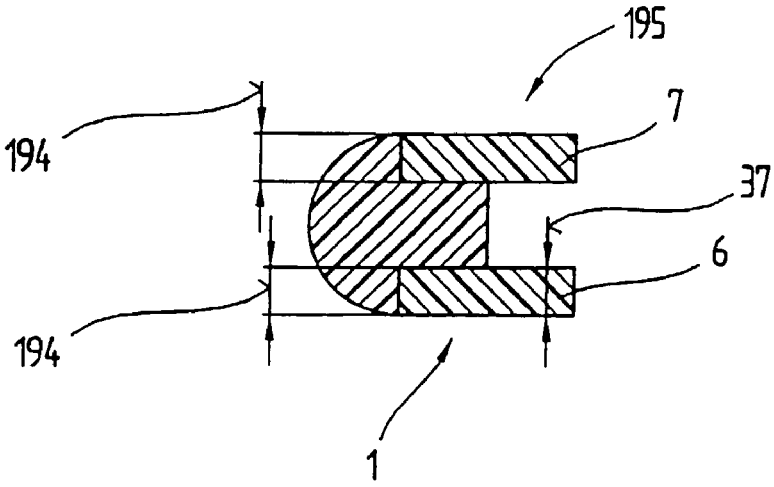
FIG. 34 a sectional view of a part area of the central part of the storage case according to the inventions FIG. 35 a further embodiment variant of the base plate 6 from above.

In the jointly described FIGS. 32 to 34 a further alternative embodiment of the storage case 1 is shown. In this case, the latter is constructed in three parts, the cover plate 7 and base plate 6 being separated by a central part 195. The central part 195 in this case has recesses 196 serving to receive articles of daily use 9 or consumer articles shown in FIG. I. The central part 195 has marginal ledges 197 which have a marginal ledge height 198. Webs 199, which project in the direction of the recess 196 and have a web height 200 of less than the marginal ledge height 198, are preferably located on the marginal ledges 197 and integrally connected thereto. As a result of this, the already described shoulder 193 is formed which serves to receive the base plate 6 or cover plate 7. The sum of twice the shoulder depth 194 and the web height 200 gives the marginal ledge height 198, whereby the shoulder depth 194 corresponds to the thickness 37 of the cover plate 6.

Figure 35:
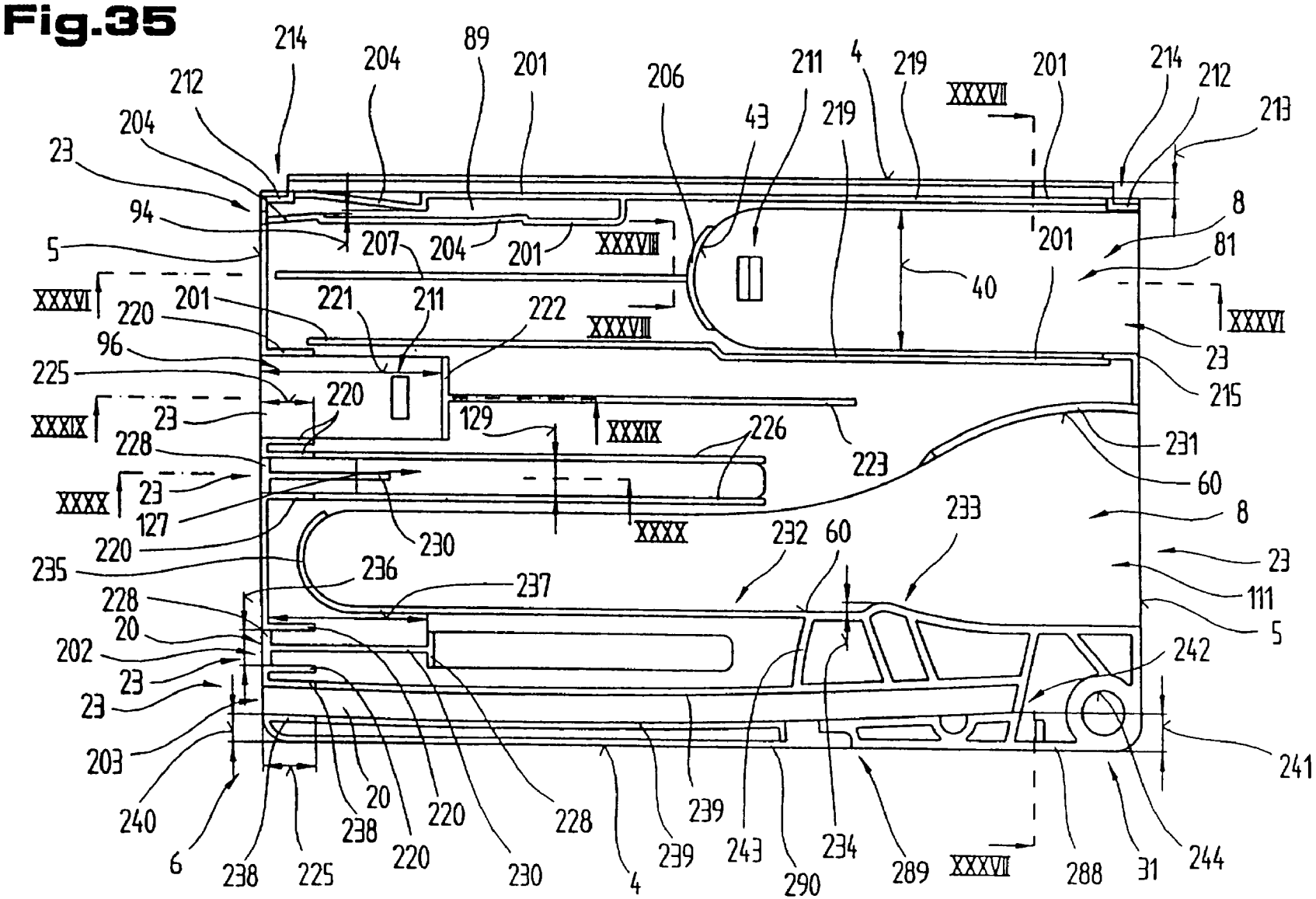
Figure 36:
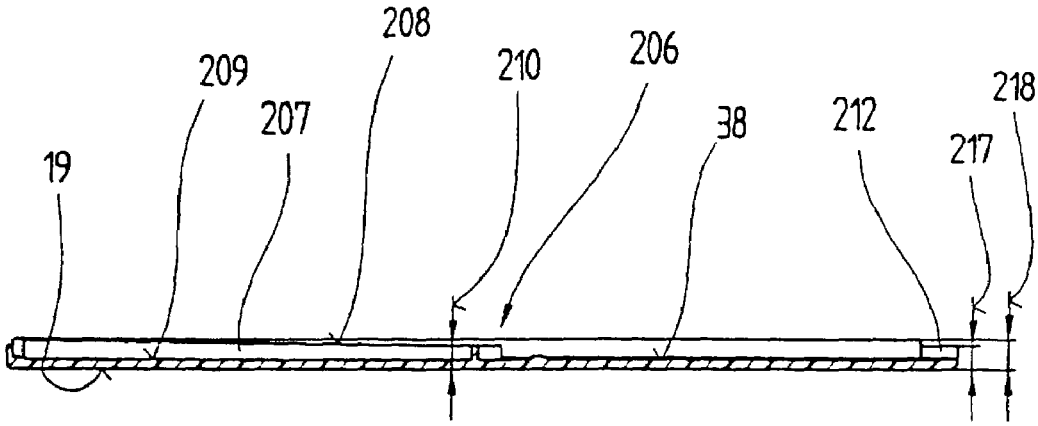
FIG. 36 the base plate, in section, along lines XXXVI-XXXVI of FIG. 35.
Figure 37:
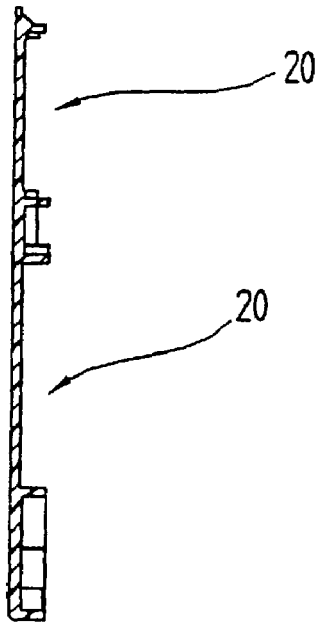
FIG. 37 the base plate, in section, along lines XXXVII-XXXVII of FIG. 35.

In FIGS. 35 to 40 a further embodiment variant of the base plate 6 is shown. The sections of the storage compartment 8 formed by the recess grooves 20 are at least partly delimited by compartment webs 201. The recess grooves 20 here form a knife recess groove 81, a needle recess groove 89, a file recess groove 96, a tweezers recess groove 127, a scissor recess groove 111, a toothpick recess groove 202 formed by the recess groove 20 for the toothpick 34 shown as an article of daily use 9 in FIG. 1 and a ball pen recess groove 203 which is also formed by a recess groove 20. Compartment webs 201 for the needle recess groove 89 are delimited in sections by part webs 204, which are fitted relative to one another at an angle to the transverse side face 5 and are spaced apart by the groove width 94 parallel to the transverse side face 5. The latter is smaller than a diameter of a needle 205 to be inserted into the needle recess groove 89. By means of the angular part webs 204 the needle 205, when it is inserted into the needle recess groove 89, is held by frictional grip so that the needle 205 on insertion into the needle recess groove 89 is turned by the first part web 204 arranged adjacent to the transverse side face 5 up to the part web 204 opposite thereto and is turned back from here to the part web 204 spaced furthest apart from the transverse side face 5. In this way there is an elastic deformation of the needle 205 in the needle recess groove 89, whereby the needle 205 is held automatically in the needle recess groove 89. The knife recess groove 81, in particular the section thereof which is for mounting the knife handle 17 comprises a stop web 206 forming the curved surface 43 which prevents a penetration of the knife handle 17 in the direction of the storage opening 23 for the needle 205. In connection with the stop web 206 extends a clamping web 207 preferably parallel to the longitudinal side face 4 in the direction of the storage opening 23 of the needle 205. The latter—as shown in FIG. 36—forms a clamping surface 208 which is inclined relative to a base surface 209 preferably parallel to the bottom side 19. The clamping surface 208 is spaced apart in the region of the stop web 206 by a height 210 which increases in the direction of the transverse side face 5 with the storage opening 23 of the needle 205. On the groove base 38 of the knife recess groove 81 a holding projection 211 is arranged which projects over the groove base 38 opposite the bottom side 19. In the region of the storage opening 23 of the knife recess groove 81 is arranged a centering web 212 running parallel to the longitudinal side face 4 which is arranged by the longitudinal side face 4 by a free position width 213 at right angles thereto of a free position in the corner between the longitudinal side face 4 and the transverse side face 5. Compartment webs 201 for the knife recess groove 81 running parallel to one another and to the longitudinal side face 4, particularly in the region of the knife handle 17 are spaced apart from one another by the groove width 40 parallel to the transverse side face 5.

The storage opening 23 of the knife recess groove 81 has a centering web 215 at right angles to the transverse side face 5 adjacent to the scissor recess groove 111. The longitudinal side face 4 also has in a corner region between the latter and the transverse side face 5 having the storage opening 23 for the needle 205 a free position 214 with a centering web 212.

Figure 38:
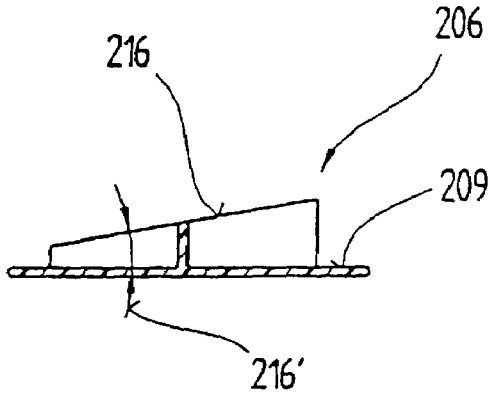
FIG. 38 a section of the base plate, in section, along line XXXVIII-XXXVIII of FIG. 35.
Figure 39:
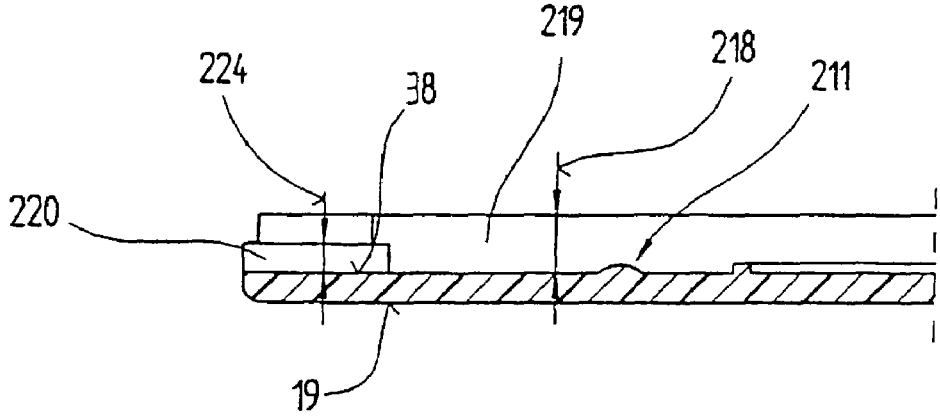
FIG. 39 a section of the base plate, in section along lines XXXIX-XXXIX of FIG. 35.

The stop web 206 has an inclined face 216 as shown in FIG. 38 which is at an angle 216 of about 30 to 250 to the base surface 209. The centering webs 212 and 215 have a centering web height 217 measured at right angles to the bottom side 19 which is smaller than a web height 118 of the compartment webs 201 designed as longitudinal webs 219.

In the transverse side face 5 which has the storage opening 23 for the needle 205 the storage opening 23 for the storage compartment 8 for the file 22 is arranged. The file recess groove 96 also has a holding projection 211 and is delimited in the region of the storage opening 23 by centering webs 220 which are at right angles to the transverse side face 5. In a depth 221 at right angles to the transverse side face 5 is a stop web 222 parallel to the transverse side face 5 and in connection therewith a clamping web 223 arranged at right angles to the transverse side face 5. The centering webs 220 have a centering web height 224 which lifts at rights angles over the groove base 38 in a direction opposite to the bottom side 19. The centering web height 224 is thus smaller than the web height 118 of the longitudinal webs 219 parallel thereto.

Figure 40:
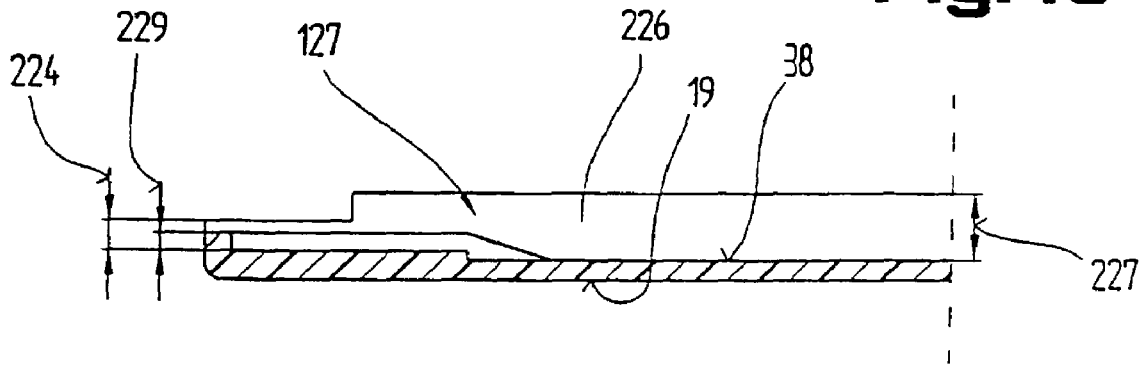
FIG. 40 a section of the base plate, in section, along lines XXXX-XXXX of FIG. 35.

In a region between the file recess groove 96 and the scissor recess groove Ill is the tweezers recess groove 127. The storage opening 23 of the tweezers recess groove 127 is partly delimited by two centering webs 220 parallel to one another and at right angles to the transverse side face 5. The latter run like those partly delimiting the file recess groove 96 from the transverse side face 5 to a web length 225 which delimit the centering webs 220 in a direction at right angles to the transverse side face 5. In connection with the web length 225 at right angles to the transverse side face S and aligned with the centering webs 220 extend longitudinal webs 226. The latter are delimited—as shown in FIG. 40—in opposite direction to the bottom side 19 by a web height 227 at right angles to the groove base 38, which is greater than the centering web height 224 parallel thereto. The storage opening 23 of the tweezers recess groove 127 is delimited further in the direction of the bottom side 19 by a transverse web 228 which runs over the entire groove width 129 of the tweezers recess groove 127 and which has a transverse web height 229 which is smaller than the centering web height 224 or the web height 227. A clamping web 230 running parallel to the longitudinal webs 226 extends from the transverse web 228 halving the groove width 129.

In the transverse side face 5 which faces away from the transverse side face 5 having for example the storage opening 23 for the needle 205 is the storage opening 23 for the scissor recess groove 111. In the direction of the knife recess groove 81 the latter is delimited by a curved web 231 which is concave in relation to the transverse side face 5. On a side averted from the knife recess groove 81 the curved web 231 forms the flank face 60. On a side averted from the tweezers recess groove 127 of the scissor recess groove 111 is a longitudinal web 232 which has a shaping 233 in one section which projects from the flank face 60 of the longitudinal web 232 in the direction of the curved web 231 by a depth 234 which is parallel to the transverse side face 5. In an end region thereof opposite the storage opening 23 of the scissor recess groove 111 is a stop web 235 which at least partly surrounds a semi-circle.

In the transverse side face 5 which faces away from the other transverse side face 5 with the section of the storage opening 23 for the scissor recess groove 111 is a part of the storage opening 23 of the toothpick recess groove 202. The section of the storage opening 23 is delimited by two centering webs 220 at right angles to the transverse side face S and a transverse web 228 parallel to the transverse side face 5. The centering webs 220 are spaced apart from one another by a groove width 236 which is halved by a clamping web 230. The latter runs from the transverse side face 5 at right angles thereto and is delimited by a clamping web length 237 on which the second transverse web 228 parallel to the transverse side face 5 is arranged.

On the transverse side face 5 which has the sections of the storage openings 23, for example for the toothpick recess groove 202 or tweezers recess groove 127, is a further section of a storage opening 23 for the ball pen recess groove 203. The latter is partly delimited by centering webs 238 which run at an angle from the transverse side face 5 up to the web length 225. In connection with the centering webs 238, i.e. in connection with the web length 225 extend longitudinal webs 239 which run curved symmetrically relative to one another, so that a region of the storage opening 23 of the ball pen recess groove 203 adjacent to the longitudinal side face 4 is distanced from the longitudinal side face 4 by a distance 240 which is parallel to the transverse side face 5 and which is smaller than a distance 241 of the longitudinal side web 239 adjacent to the longitudinal side face 4 in the end region 242 of the ball pen recess groove 203. In this way it is achieved that on inserting a ball pen into the ball pen recess groove 203 the latter is deformed elastically and is held automatically in the ball pen recess groove 203. A connecting web 243 is also important which runs between the longitudinal web 232 of the scissor recess groove 111 and the adjacent longitudinal web 239 of the ball pen recess groove 203 and is arranged in the region of the shaping 233. In a corner between the longitudinal side face 4 and the transverse side face S is the swivel mount 31 which is formed in this embodiment variant by a swivel bearing bore 244.

In FIGS. 41 to 46 the cover plate 7 is shown. The latter is delimited by the parallel longitudinal side faces 4 and the transverse side faces 5 running perpendicular thereto and parallel to one another. Along a longitudinal side face 4 runs a centering web 245 which in the corner regions 246 has centering extensions 247. The longitudinal side face 4 has an inclined surface 11 inclined relative to the top side 10. Facing away from the top side 10 and parallel thereto is an inner side 248 delimiting the centering extensions 247, which is spaced apart from the top side 10 by a height 249. Said height 249 forms the thickness 35 of the storage case I shown in FIG. 2, as the centering extensions 247 engage in the free positions 214 of the base plate 6 shown in FIG. 35 and close evenly with the bottom side 19.

The cover plate 7 has the opening 61 for the recess groove 20 of the knife blade 16, whereby the opening 61 is in particular for the storage of the knife handle 17. The opening 61 is here, as shown better in FIG. 43, delimited by a bordering web 250 which runs partly parallel to the longitudinal side face 4 and the opening 61 is delimited in the direction of a transverse side face 5 by the face 63. The bordering web 250, in particular two longitudinal webs 251 parallel to one another and to the longitudinal side face 4 and forming sections of the bordering web 250 have facing inner sides 252 which are formed from vertical surfaces 253 at right angles to the top side 10 and curved surfaces 254 in the direction of the top side 10, so that an opening width 255 at right angles to the longitudinal side face 4 spacing the vertical faces 253 apart is larger than a width 256 measured in the section of the curved surfaces 254 with the top side 10 parallel to the opening width 255.

In connection to the longitudinal webs 251 are curved webs 257 with which longitudinal webs 258 opposite to the opening 61 join, from which the one arranged next to the longitudinal side face 4 or the centering web 245 measured parallel to the longitudinal side face 4 is shorter than the longitudinal web 258 which is further from the centering web 245. The groove base 38 of the knife recess groove 81 arranged in the cover plate 7 is partially inclined to the top side 10.

In the opposite direction to the longitudinal side face 4 is the file recess groove 96 arranged in the cover plate 7. The latter has a recess 24 which is delimited by web-shaped centering recesses 259. In connection with the web-like centering recesses 259 extend longitudinal webs 260 parallel to the longitudinal side face 4 and at a depth 261 of the recess face 262 delimiting the recess 24 which is arranged by the transverse side face 5 in the direction of the second transverse side face 5 facing away therefrom in which the opening 61 for the knife 15, in particular for the knife handle 17 is located, a transverse web 263 is arranged at right angles to the longitudinal webs 260. From the transverse webs 263 in the opposite direction to the recess 24 extends a clamping web 264 in a half distance of the groove width 99 of the file recess groove 96. The recess face 262 is spaced apart from the transverse side face 5 by a face depth 265 in the direction of the additional transverse side face 5. The next recess groove 20 which is arranged in the cover plate 7 is the tweezers recess groove 127. The latter also has the recess 24 which with the recess face 262 is spaced apart from the transverse side face 5 by the face depth 265.

Figure 46:
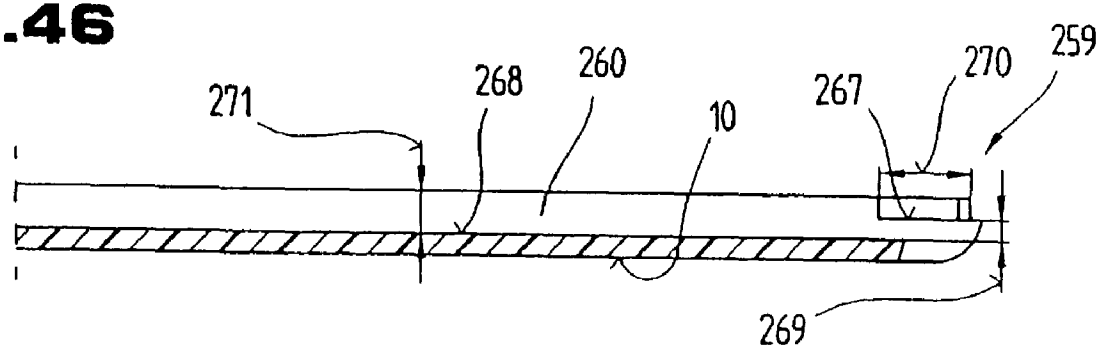
FIG. 46 a section of the base plate of the invention, in section along the lines XXXXVI-XXXXVI of FIG. 41.
Figure 42:
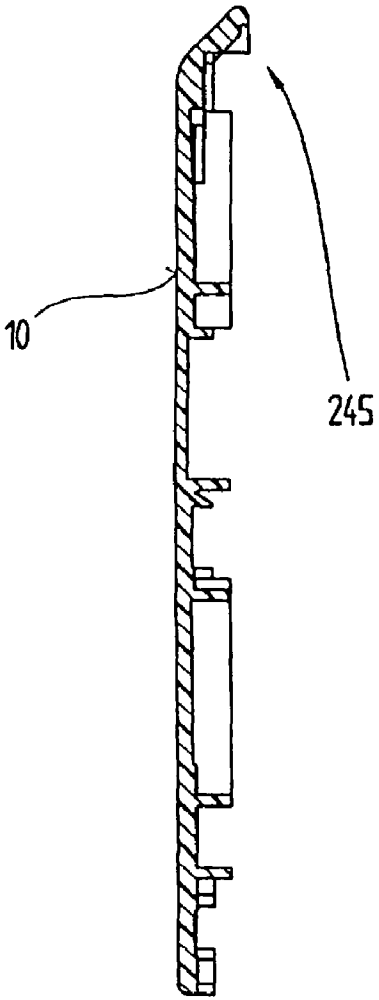
FIG. 42 the cover plate, in section along the lines XXXXII-XXXXII of FIG. 41.

The tweezers recess groove 127 is also delimited by the web-like centering recess 259. Furthermore, it is delimited by a longitudinal web 260 of the file recess groove 96 and by a longitudinal web 266 of the scissor recess groove 111. The web-like centering recesses 259 have—as shown in FIG. 46—a top side 267 which is spaced apart from a base surface 268 parallel to the top side 10 by a height 269. Furthermore, the centering recesses 259 run to a depth 270, in the connection of which for example the longitudinal webs 260 extend which are spaced apart from the base surface 268 by a web height 271. The web height 271 is here greater than the height 269. A further recess groove 20 is formed by the scissor recess groove 111 which is also arranged on the cover plate 7. The latter is partly delimited by the longitudinal web 266 delimiting the tweezers recess groove 127 which in the direction of a quarter circle recess 272 has a curved path and is continued in a circular shaped guide web 273. The latter forms the guide surface 65 for the swivel plate 28. The guide face 65 runs in a curved radius 66 from a fictitious centre point 52. In the region of the top side 10 the guide face 65 has a web 274 which projects at right angles to the guide surface 65 in the direction of the centre point 52 and has a ring face 72 at right angles to the guiding surface 65 facing away from the top side 10.

The longitudinal web 251 of the opening 61 for the knife handle 17 also has a web-like centering recess 259. The file recess groove 96, in particular the transverse web 263 and the clamping web 264 have—as can be clearly seen in FIG. 44—a surface 275 which is spaced apart from a bearing surface 276 parallel to the top side 10 by a height 277 in the opposite direction to the top side 10.

An additional recess groove 20 forms the toothpick recess groove arranged on the cover plate 7. The latter also comprises the recess 24 which is delimited by the recess face 262 which is spaced apart by the face depth 265 from the transverse side face 5 in the direction of the approximately quarter circular recess 272.

Figure 45:
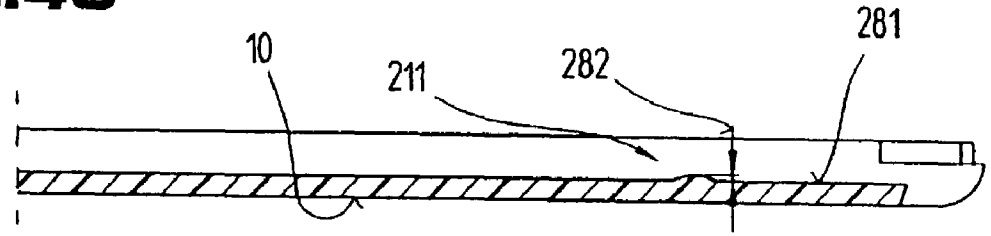
FIG. 45 a section of the base slate of the invention, in section along the lines XXXXV-XXXXV of FIG. 41.

The toothpick recess groove 202 is delimited by two parallel longitudinal webs 278 which are at right angles to the transverse side face 5. The sections of the longitudinal webs 278 assigned to the recess 24 form web-like centering recesses 259. Furthermore, there is a holding projection 211 in the toothpick recess groove 202. Between the centering recesses 259 of the toothpick recess groove 202 and the adjacent centering recess 259 of the tweezers recess groove 127 is a centering web 279 parallel to the transverse side face 5. Also a centering web 279 runs from the centering recess 259 of the file recess groove 96 adjacent to the longitudinal side face 4 in the direction of the centering extension 247. The recess groove 20 spaced furthest apart from the longitudinal side face 4 forms the ball pen recess groove 203 arranged in the top part 7 which also has a recess 24. The recess 24 is here delimited by web-like centering recesses 259. In the corner region between the transverse side face 5 and the longitudinal side face 4 is a centering extension 280 running in a quarter circle. The toothpick recess groove 202 has, as already explained, the holding projection 211 which—as shown in FIG. 45—projects over a base surface 281 parallel to the top side 10 by a projection height 282 in an opposite direction to the top side 10.

Figure 47:
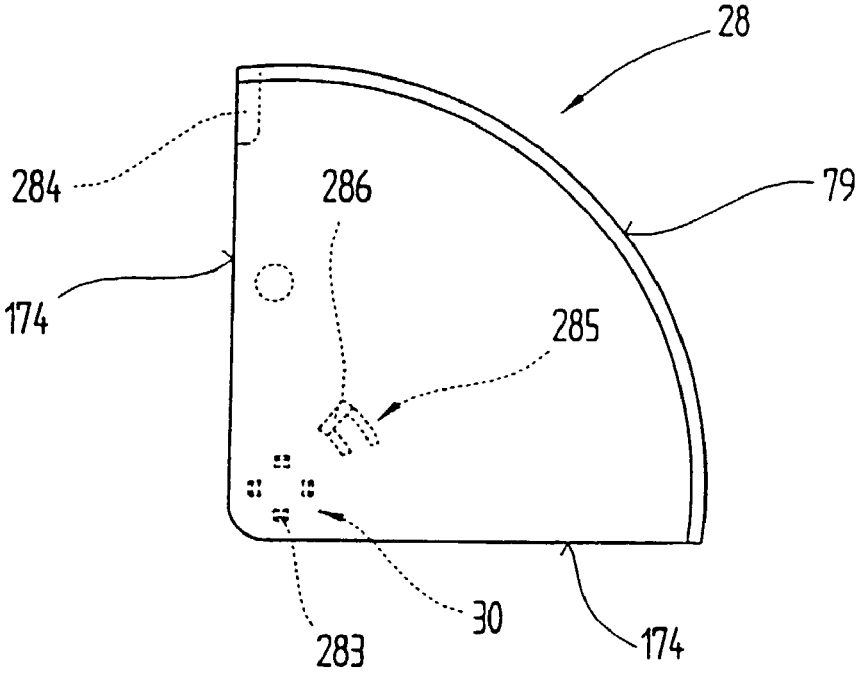
FIG. 47 a further embodiment variant of the pivot plate of the invention in plan view.
Figure 48:
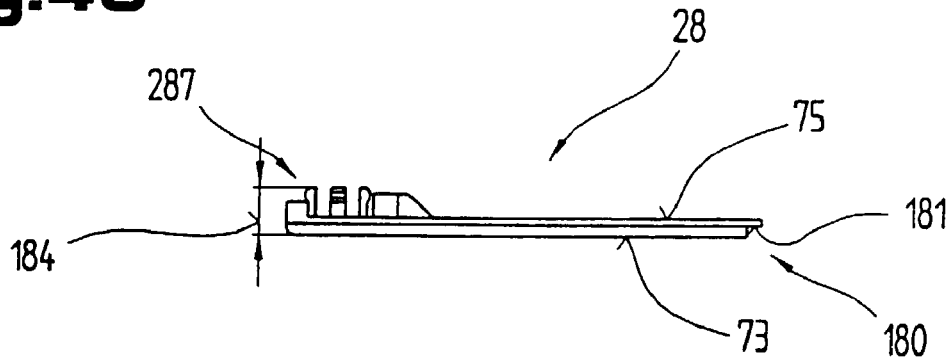
FIG. 48 the pivot plate of the invention in side view.

In the additionally described FIGS. 47 and 48 a further embodiment variant of the swivel plate 28 is shown. The swivel pin 30 is formed here by pin webs 283 offset at 900 to one another which project over the inner side 75 of the swivel plate 28 on the side averted from top side 73. They thus extend from the top side 73 by the height 184. On the inside 75 a stop web 284 also formed which projects from the outer ring face 79 in the direction of the pin webs 283. Furthermore, the swivel plate 28 has a stepped portion 180 which is formed by a ring face 181 parallel to the top side 73. The swivel plate 28 also has a swivel stop 285 which is formed by the stop webs 286 projecting over the inner side 75 opposite the top side 73.

The assembly of the storage case 1 is performed as follows. Firstly, the swivel plate 28 is arranged on the base plate 6 in that the pin webs 283 forming the swivel pin 30 are inserted in to the swivel bearing bore 244. The pin webs 283 are here deformed elastically in a facing direction and by means of arresting projections 287 shown in FIG. 48 effect a securement against movements directed perpendicular to the inner side 75, i.e. axially, and thus a securement against automatic detachment of the swivel plate 28 from the swivel bearing bore 244. The swivel plate 28 can now be pivoted along the curved web 231 by an angle of about 450 until the swivel stop 285 stops dn a delimiting web 288 arranged in the region of the swivel bearing bore 244 and shown in FIG. 35. If the pivot plate 28 is pivoted back so that the faces 174 correspond approximately with a longitudinal side face 4 or transverse side face 5 the stop web 284 is in a shaping 289 shown in FIG. 35 which is arranged in an edge web 290 running along the longitudinal side face 4.

Figure 43:
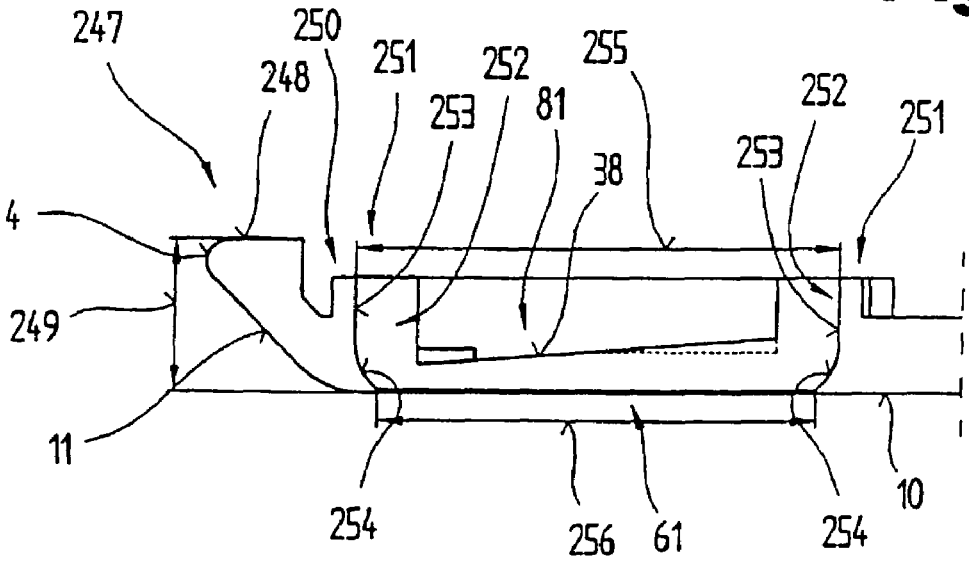
FIG. 43 a section of the cover plate of the invention viewed along arrow XXXXII of FIG. 41.
Figure 41:
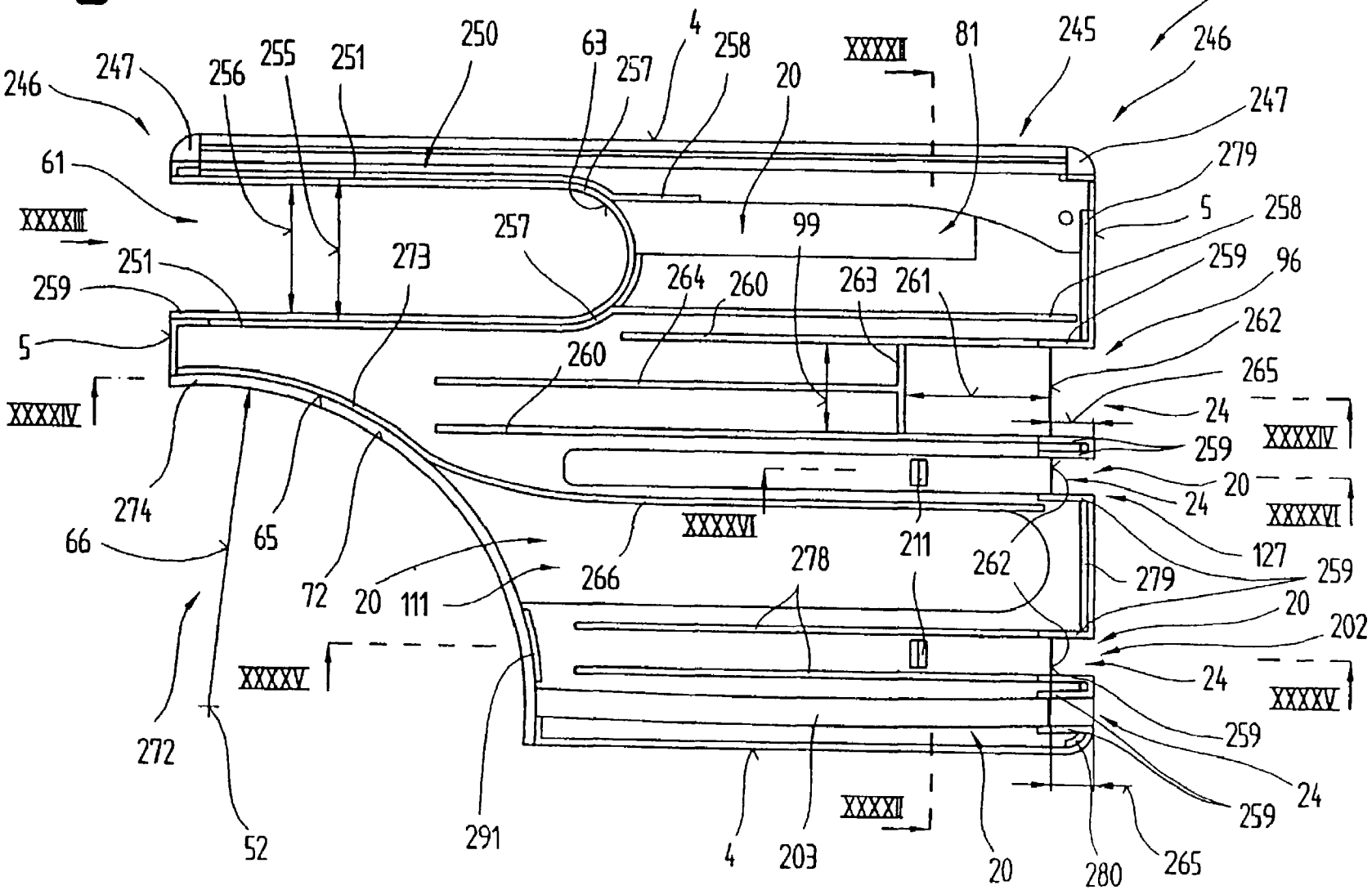
FIG. 41 a further embodiment variant of the cover plate of the invention from above.
Figure 44:
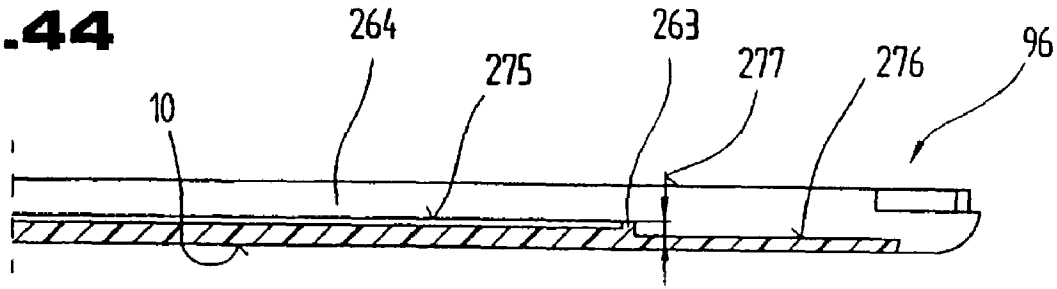
FIG. 44 a section of the base plate of the invention, in section, along the lines XXXXIV-XXXXIV of FIG. 41.

If the pivot plate 28 has been fixed to the base plate 6 by inserting the pin webs 283 into the swivel bearing bore 244 the cover plate 7 can now be fitted onto the base plate 6. Here the centering extensions 247 as shown in particular in FIG. 43 are inserted into the free positions 214 of the base plate 6. Furthermore, for example the centering webs 215, as shown in FIG. 35, are brought into a congruent position with the centering recesses 259. Furthermore, a part web 291 shown in FIG. 41 also in the curved radius 66 is brought into engagement with the connecting web 243 shown in FIG. 35, 50 that by the stop of the part web 291 on the connection web 243 a parallel displacement of the base plate 6 and the cover plate 7 is avoided. Such a displacement is also prevented by the guide web 273 shown in FIG. 41 the guide surface 65 of which is brought into contact with a surface shown in FIG. 35 averted from the flank face 60 of the curved web 231 50 that the cover and base plate 7, 6 are fixed relative to one another in a specific position.

Figure 49:
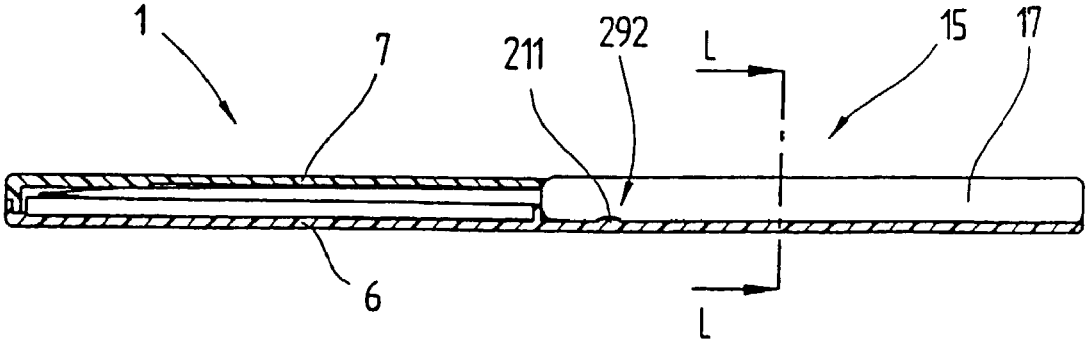
FIG. 49 the storage housing of the invention with inserted article in particular a knife, in section, in side view.

By way of example in FIG. 49 the arrangement of the knife 15 in the storage case I is shown. Here it is shown that the knife 15 in particular the knife handle 17 has a shaping 292 in which the holding projection 211 engages and thus prevents a relative movement of the knife 15 to the storage case 1.

By the selection of material and above all determining the wall thicknesses of the different webs or connecting webs and the base and cover plate 6, 7 an elastic adjustability thereof is made possible which for example can be used to check or secure the article of daily use 9 and/or consumer articles.

Thus for example if the knife 15 is inserted into the storage case 1, when it is pushed away over the holding projection 211 by an elastic self restoring deformation the base or cover plate 6,7 deflect until the holding projection 211 engages in the shaping 292 in the knife handle 17.

The connection between the base and cover plate 6, 7 is formed by a layer of adhesive or by ultrasound welding or the like.

Figure 50:
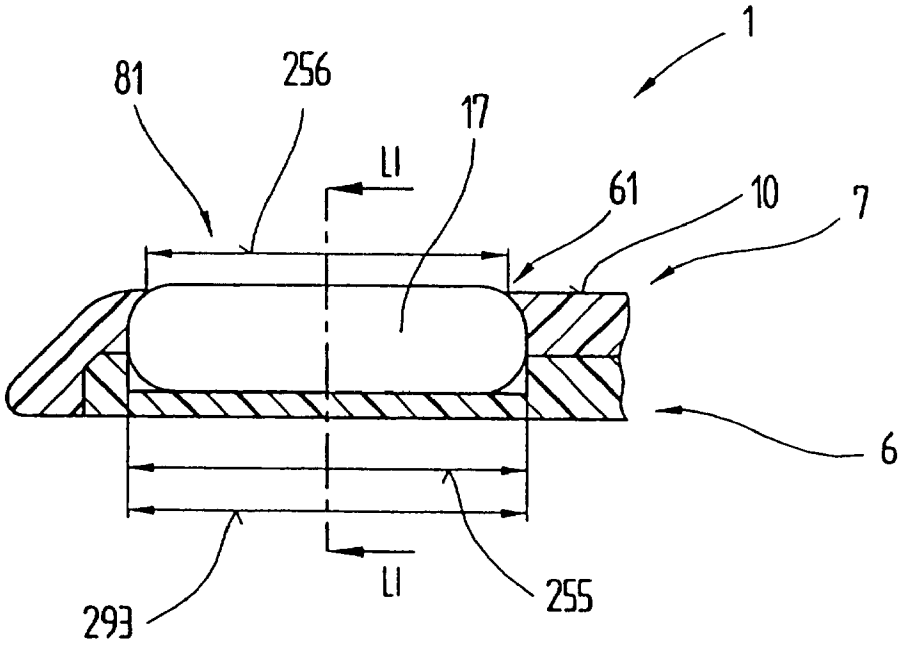
FIG. 50 a section of the storage case according to the invention in section, along the lines L-L of FIG. 49.

In FIG. 50 a detail of the storage case 1 is shown in an assembled state. It is shown here how the cover plate 7 and the base plate 6 form the knife recess groove 81 in the region of the knife handle 17. The knife handle 17 is delimited by a knife handle width 293 which corresponds approximately to the opening width 255 of the knife recess groove 81. The knife handle width 293 is smaller than the width 256 of the opening 61. In this way the knife handle 17 is secured against movement at right angles to the top side 10.

Figure 51:
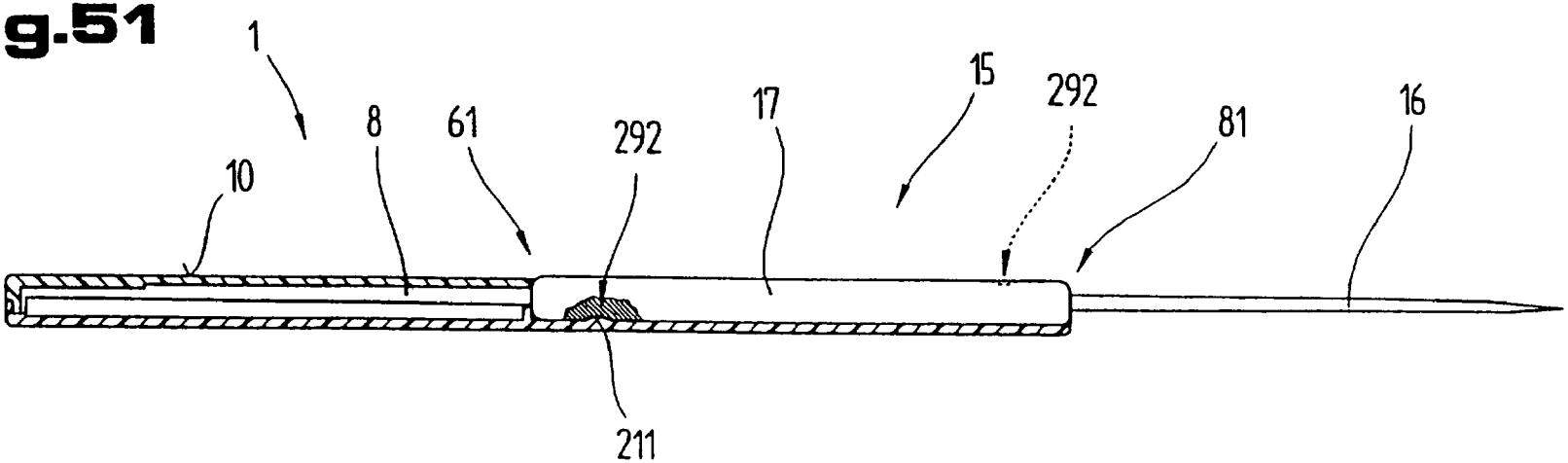
FIG. 51 the storage case according to the invention in section along the lines LI-LI of FIG. 50.

In FIG. 51 it is shown that the knife 15 is arranged in the storage case I so that only the knife handle 17 is arranged in the knife recess groove 81, in particular in the region of the opening 61. The knife blade 16 thus projects in an opposite direction to the storage compartment 8 of the knife 15. The mounting or the securing of the knife handle 17 against movement at right angles to the top side 10 is described in FIG. 50. The mounting or securing against movement parallel to the top side 10 opposite the storage compartment 8 for the knife 15 is produced by the holding projection 211, which engages with the shaping 292 also arranged in the knife handle 17. The knife handle 17 as a result comprises two shapings 292 which are arranged on opposite surfaces. In this way the knife handle 17 can be used in the storage case 1 with the knife blade 16 projecting over the storage case 1, whereby the knife 17 can be handled more easily. This is an advantage particularly if the knife 17 is used for example as a letter opener.

Figure 52:
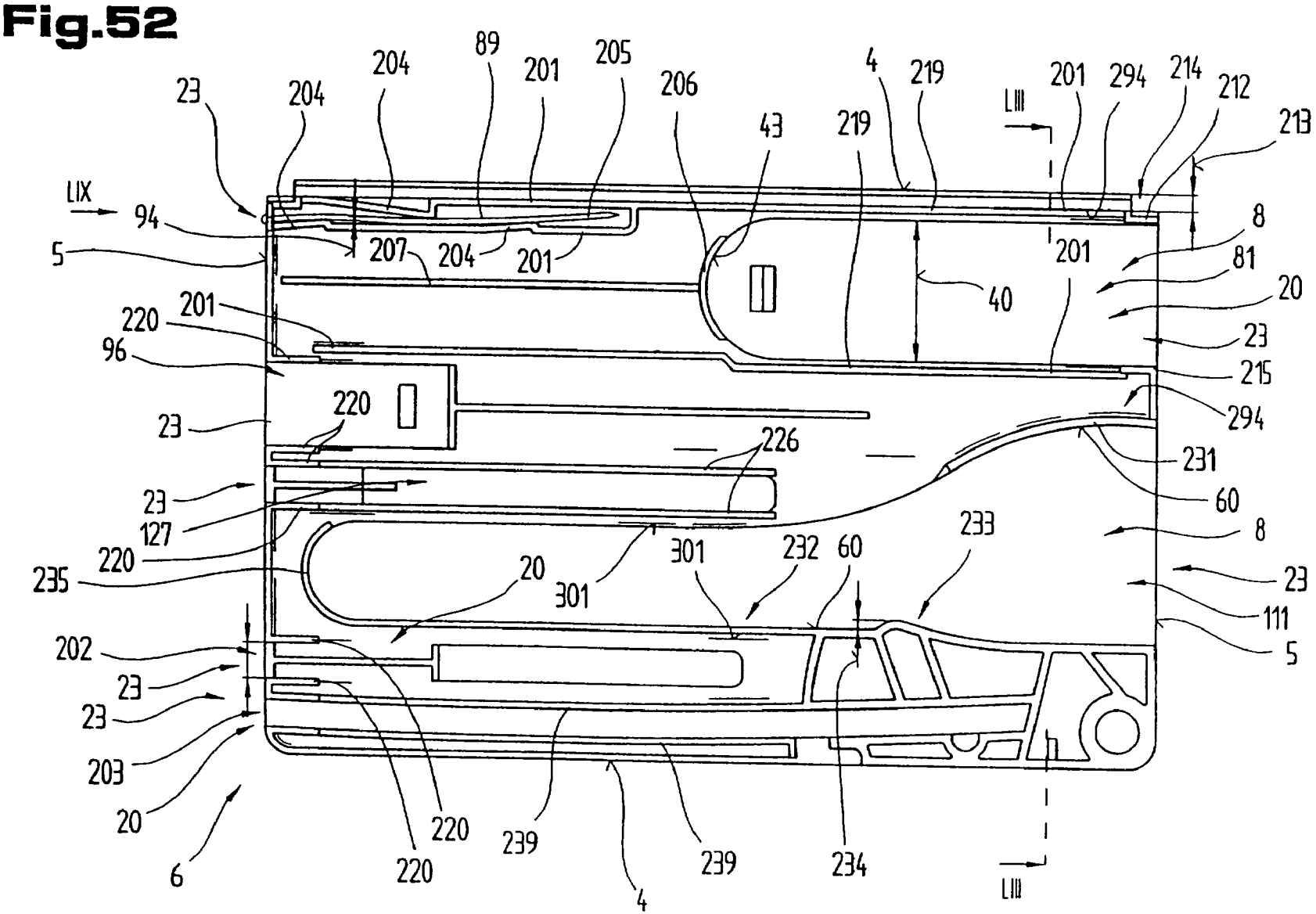
FIG. 52 a different embodiment variant of tie base plate according to the invention in plan view.
Figure 53:
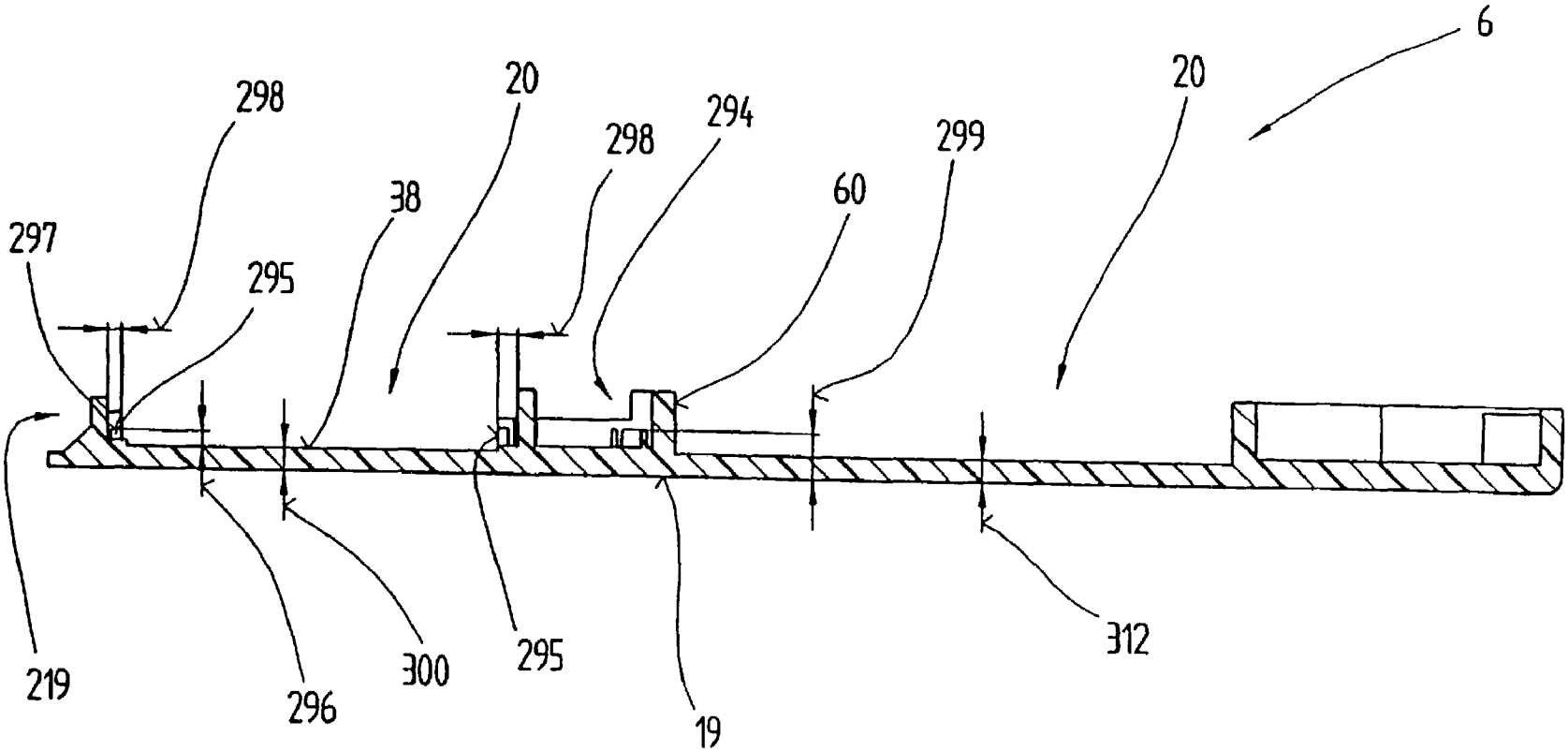
FIG. 53 the base plate according to the invention, in section along the lines LiI-LII of FIG. 52.

In the jointly described FIGS. 52 and 53 a further embodiment of the base plate 6 is shown. The sections of the storage compartments 8 formed by the recess grooves 20 are at least partly delimited by compartment webs 201. The recess grooves 20 here form a knife recess groove 81, a needle recess groove 89, a file recess groove 96, a tweezers recess groove 127, a scissor recess groove 111, a toothpick recess groove 202 formed by the recess groove 20 for the toothpick 34 shown in FIG. 1 as the article of daily use 9, and a ball pen recess groove 203 which is also formed by a recess groove 20. Compartment webs 201 for the needle recess groove 89 are formed in sections by tart webs 204, which run at an angle relative to the transverse side face 5 and are spaced apart from one another by the groove width 94 measured parallel to the transverse side face S. The latter groove width S is smaller than the diameter of a needle 205 to be inserted into the needle recess groove 89. The needle 205 is, as already described, deformed elastically and held on insertion into the needle recess groove 89.

The knife recess groove 81, in particular the section thereof for holding the knife handle 17, comprises a stop web 206 forming the curved surface 43 which prevents penetration of the knife handle 17 in the direction of the storage opening 23 of the needle 205. Connected to the stop web 206 extends a clamping web 207 running preferably parallel to the longitudinal side face 4 in the direction of the storage opening 23 of the needle 205. In the region of the storage opening 23 of the knife recess groove 81 a centering web 212 running parallel to the longitudinal side face 4 is arranged, which is arranged from the longitudinal side face 4 by a free position width 213 perpendicular thereto of a free position 214 arranged in the corner between the longitudinal side face 4 and the transverse side face 5. Longitudinal webs 219 for the knife recess groove 81 running parallel to one another and to the longitudinal side face 4, in particular in the region of the knife handle 17, are spaced apart from one another by a width measured parallel to the transverse side face 5, which is larger than the groove width 40.

The storage opening 23 of the knife recess groove 81 has adjacent to the scissor recess groove 111 a centering web 215 perpendicular to the transverse side face 5. The base plate 6 also has connecting webs 294, two of which are arranged in the region of the storage opening 23 of the knife recess groove 81. The latter run parallel to the longitudinal side face 4 connected to the centering webs 212 and 215 in the direction of the needle recess groove 89 and are spaced apart by the groove width 40 on inside faces 295 which face one another and are perpendicular to the groove base 38. The connecting webs 294 have a connecting web height 296 from the groove base 38 to the bottom side 19, which delimits a connecting web top side 297 opposite the bottom side 19. The longitudinal webs 219 run from the inside surface 295 spaced part by a gap width 298 parallel to the groove width 40. In the transverse side face S which faces away from the transverse side face 5 comprising for example the storage opening 23 for the needle 205 is the storage opening for the scissor recess groove Ill. In the direction of the knife recess groove 81 the latter is delimited by a curved web 231 which is concave relative to the transverse side face S. On a side opposite the knife recess groove 81 the curved web 231 forms the flank face 60. On a side of the scissor recess groove 111 facing away from the tweezers recess groove 127 runs a longitudinal web 232 which has a shaping 233 in a section which projects from the flank face 60 of the longitudinal web 232 facing the flank face 60 of the curved web 231 in the direction of the curved web 231 by a depth 234, which is measured parallel to the transverse side face 5. Said shaping 233 serves to mount the scissors 26 shown in FIG. 1 by a dashed line. In an end region thereof opposite the storage opening 23 of the scissor recess groove 111 there is a stop web 235 which encloses a semicircle at least partly. Concentric to the curved web 231 in a region opposite the flank face 60 run additional connecting webs 294, which are delimited by the connecting web top side 297, which is spaced apart from the bottom side 19 by a total height 299. The total height 299 corresponds however approximately to the connecting web height 296 in addition to a groove base thickness 300 measured parallel thereto, which spaces the groove base 38 from the bottom side 19. Additional connecting webs 294 are arranged in an end region opposite the storage opening 23 of the knife recess groove 81 parallel to the transverse side face S and preferably in connection with the centering webs 220 laterally delimiting the file recess groove 96 and the toothpick recess groove 202 and parallel to the longitudinal webs 226 of the tweezers recess groove 127.

Figure 54:
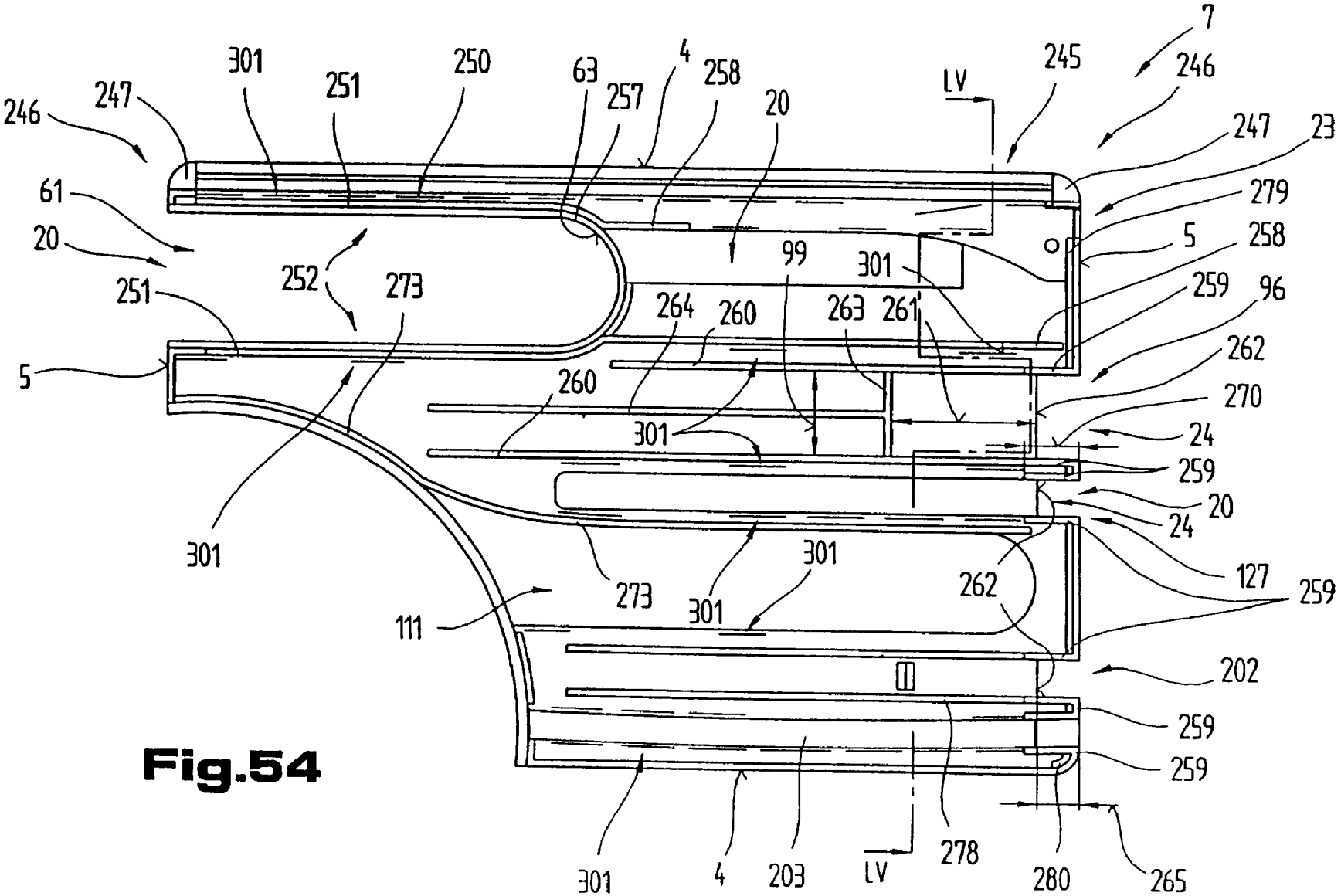
FIG. 54 a different embodiment variant of the cover plate according to the invention in plan view.
Figure 55:
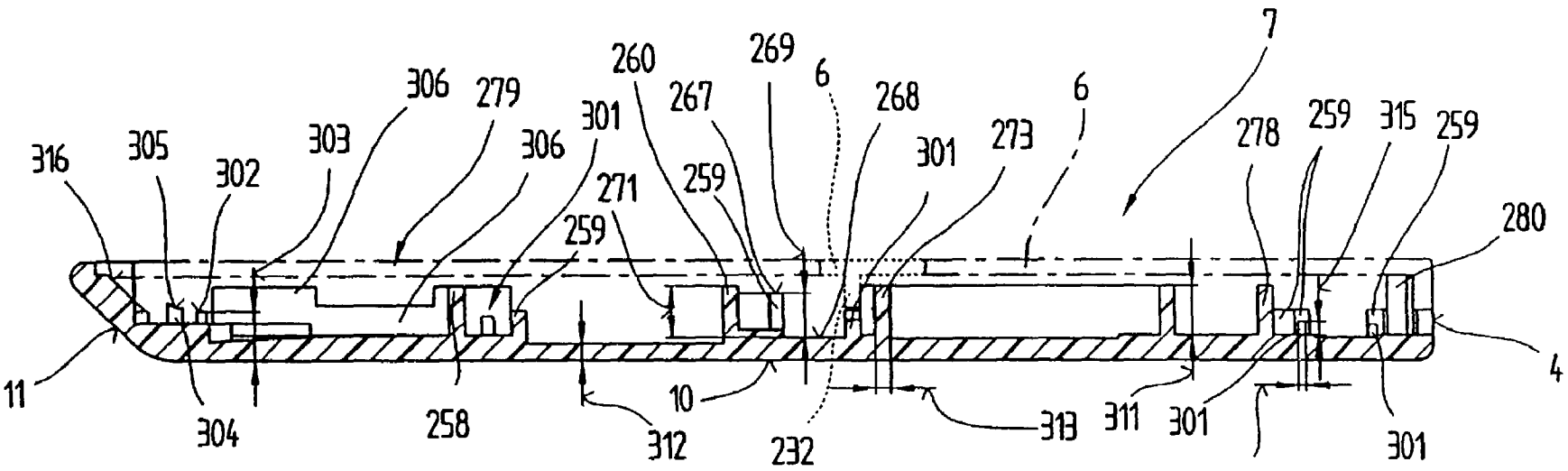
FIG. 55 the cover plate according to the invention in cross section along the lines LV-LV of FIG. 54.
Figure 59:
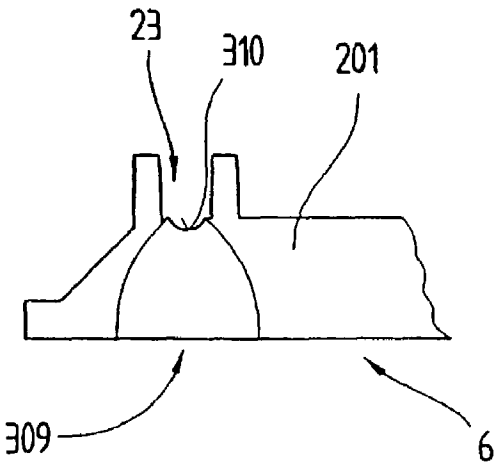
FIG. 59 a detail of a storage opening along the line LIX of FIG. 52.

In the jointly described FIGS. 54 and 55 an additional embodiment variant of the cover plate 7 is shown. The latter is delimited by the parallel longitudinal side faces 4 and the transverse side faces 5 perpendicular thereto and parallel to one another. Along a longitudinal side face 4 runs a centering web 245 which comprises centering extensions 247 in corner regions 246. The longitudinal side face 4 has an inclined surface 11 inclined relative to the top side 10.

The cover plate 7 comprises the opening 61 for the recess groove 20 of the knife blade 16 shown in FIG. 1, in which the opening 61 in particular serves to store the knife handle 17. The opening 61 is partly delimited by a delimiting web 250 which runs partly parallel to the longitudinal side face 4 and in the direction of a transverse side face S through the face 63. The delimiting web 250, in particular two longitudinal webs 251 running parallel to one another and to the longitudinal side face 4 forming sections of the delimiting web 250, comprises facing inner sides 252. In a region facing away from the inner face 252 in particular between the centering web 245 and the longitudinal web 251 and between the additional longitudinal web 251 and the guiding web 273 for the swivel plate 28 shown in FIG. 47 run connecting webs 301, which are delimited by the web undersides 302 opposite the top side 10 which are spaced apart from the top side 10 by a web height 303.

In connection with the longitudinal webs 251 run curved webs 257 which are connected with longitudinal webs 258 opposite to the opening 61 from which the longitudinal web 258 adjacent to the longitudinal side face 4 or the centering web 245, parallel to the longitudinal side face 4 is shorter than the longitudinal web 258 which is farther from the centering web 245. In a region aligned with the shorter longitudinal web 258 parallel to the longitudinal side faces 4 additional connecting webs 301 extend. The transverse side face S arranged opposite to the opening 61 has the storage opening 23 for the needle 205 shown in FIG. 52. In the storage opening 23 a needle web 304 is arranged which has a web surface 305 facing away from the top side 10 which has a curved path, and thus offers the casing surface delimiting the cross section of the needle 205 a partly enclosing bearing. The storage opening 23 is delimited by the centering web 279 opposite the centering extension 247. The centering web 279 comprises two strip-like pin extensions 306.

In the opposite direction to the longitudinal side face 4 the file recess groove 96 is arranged in the cover plate 7. The file recess groove 96 has a recess 24 which is delimited by web-like centering recesses 259. In connection with the web-like centering recesses 259 extend longitudinal webs 260 parallel to the longitudinal side face 4 and in a depth 261 from the recess front face 262 delimiting the recess 24, which from the transverse side face S in the direction of the transverse side faces, in which the opening 61 for the knife 15, in particular for the knife handle 17 is arranged, a transverse web 263 perpendicular to the longitudinal webs 260 is arranged. From the transverse web 263 extends in opposite direction to the recess 24 a clamping web 264 at half the distance of the groove width 99 of the file recess groove 96. The recess face 262 is spaced from the transverse side face 5 by a face depth 265 in the direction of the additional transverse side face S. Approximately at a half distance between the longitudinal web 258 of the knife recess groove 81 and the longitudinal web 260 of the file recess groove 96 several connecting webs 301 run parallel to the longitudinal side face 4. The next recess groove 20 which is arranged in the cover plate 7 is the tweezers recess groove 127. The latter also has the recess 24 which with the recess face 262 is spaced apart from the transverse side face 5 by the face depth 265.

The tweezers recess groove 127 is also delimited by the web-like centering recess 259. In addition, it is delimited by a longitudinal web 260 of the file recess groove 96 and by a longitudinal web 266 of the scissor recess groove 111. The web-like centering recesses 259 have a top side 267, which is spaced apart from a base surface 268 parallel to the top side 10 by a height 269. Furthermore, the centering recesses 259 run into a depth 270, in connection with which the longitudinal webs 260 extend for example which are spaced apart from the base surface 268 by a web height 271. The web height 271 is thus greater than the height 269. In connection with the web-like centering recesses 259 delimiting the recess 24 of the tweezers recess groove 127 extend additional connecting webs 301 parallel to the longitudinal side faces 4. Further connecting webs 301 are arranged in the region of the scissor recess groove 111 and the ball pen recess groove 203.

Figure 56:
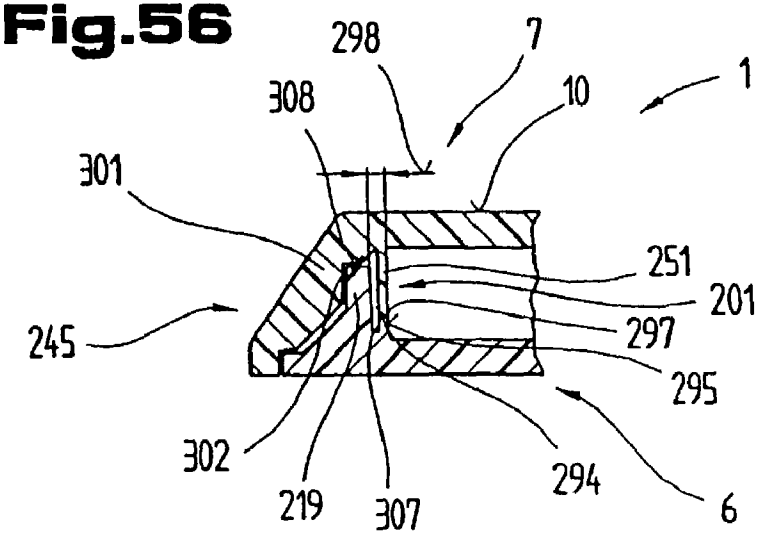
FIG. 56 a section of the storage case in an assembled state in cross-section.

In FIG. 56 a detail of the storage case I according to the invention is shown in cross section where the base plate 6 and the cover plate 7 are joined together. The connection between the base plate 6 and the cover plate 7 is such that in the region of the gap width 298 between the longitudinal web 219 and the inside surface 295 of the connecting web 294 the longitudinal web 251 of the cover plate 7 rests form-closed on the connecting web 294. Here the connecting web top side 297 and a web surface 307 of the longitudinal web 251 facing the latter and running parallel to the top side 10 are connected together, e.g. by adhesion or welding. At the same time a web surface 308 of the longitudinal web 219 is connected with the web underside 302 of the connecting web 301 which is adjacent to the centering web 245 of the cover plate 7. The said connecting system is also continued with the other connecting webs 294 and 301, which are connected respectively with corresponding compartment webs 201 on facing surfaces.

Figure 57:
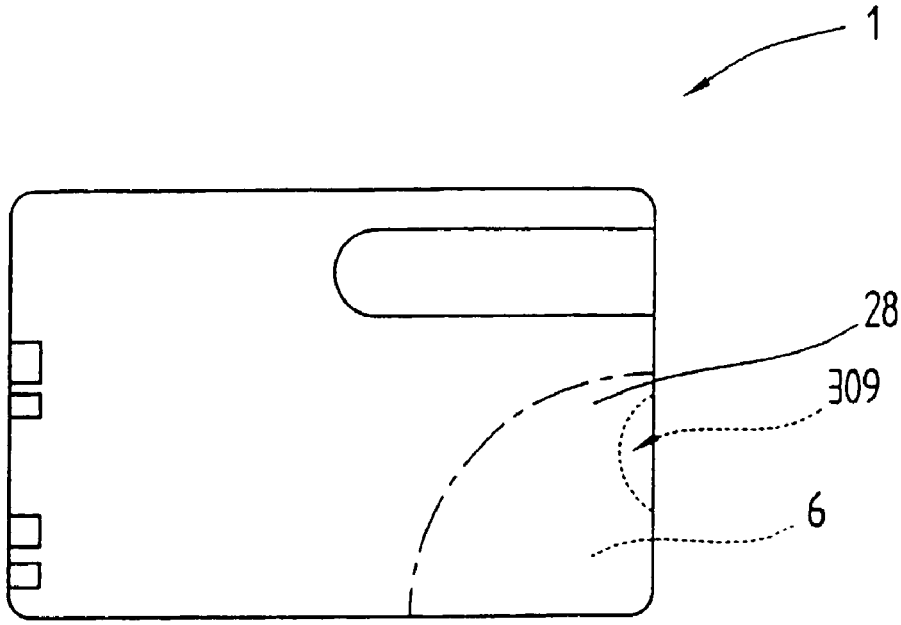
FIG. 57 a further embodiment variant of the storage case according # the invention in plan view.
Figure 58:
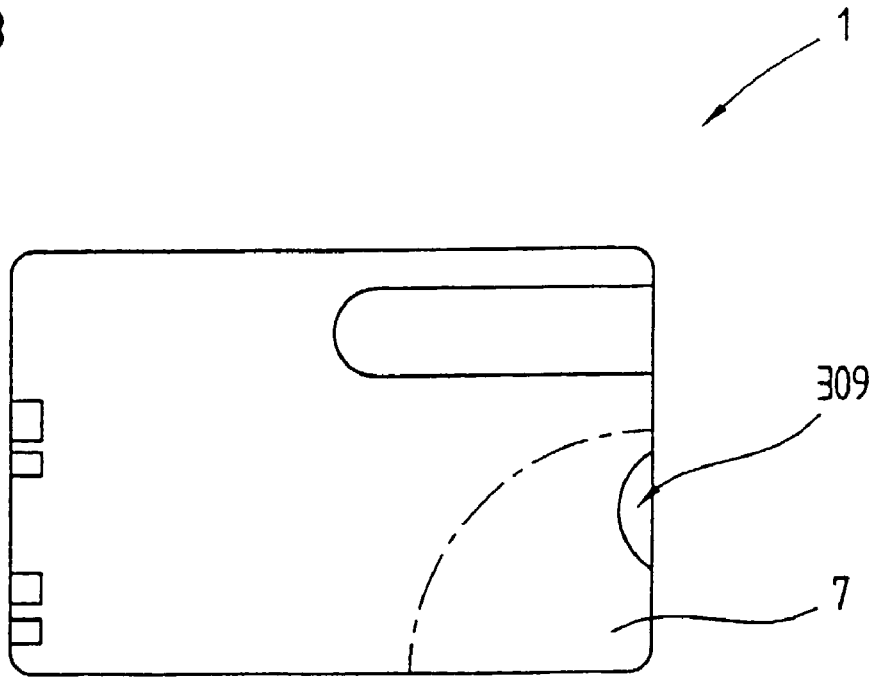
FIG. 58 a different embodiment variant of the storage case according to the invention in plan view.

In the jointly described FIGS. 57 and 58 additional variants of the storage case I are shown. The latter preferably have no swivel plate 28. There may be one however, as shown by the dot-dash lines. The storage case I comprises removal openings 309 either in the base plate 6 or the cover plate 7 which are for removing the articles of daily use shown in the other Figs. more easily. Such removal openings 309 can also be arranged in the swivel plates 28. The swivel plate 28 can also be used fixed and/or as a mirror.

It is essential for all of the card-shaped storage cases illustrated in the present embodiments that an internal height 311, i.e. the measurement perpendicular to the base or cover plate 6, 7 between the facing inner surfaces of the base or cover plate 6, 7, is equal to or greater than the thickness of the article to be stored, in particular an article of daily use 9. In this way the webs, in particular the compartment web 201, the stop web 206, the longitudinal webs 219, 226, the curved webs 231 and/or the centering webs 220, which project perpendicularly over the internal faces of the base or cover plate 6, 7 extend from the cover plate 7 in the direction of the base plate 6 or from the cover plate 7 in the direction of the cover plate 7 over the entire internal height 311, or respectively only over a part of the internal height 311, so that when the base is fitted to the cover plate 6, 7 they extend from the base plate 6 to the cover plate 7 or together form a continuous web from the base plate 6 to the cover plate 7.

The arrangement of such webs which project over the respective inner surface of the base or cover plate 6, 7 over the entire internal height 311 has the advantage that in this way extremely thin wall thicknesses 312 in the region of the base or cover plate 6, 7 can be obtained, as the required stiffening of the base or cover plate 6, 7 is obtained by the height of said webs.

It is also advantageous if the webs extend over the entire internal height 311 50 that several parallel webs are arranged distributed over the surface of the card-shaped storage case 1, so that the component can be ribbed and in this way even thin wall thicknesses 312 or thicknesses 313 of the webs can be obtained, so that it is possible with the said card-shaped storage case I on manufacture by injection moulding to distribute the plastic evenly in all cavities.

Of course, this design of the thickness 31 applies not only to the guiding web 273, but also to all other webs, named specifically in the above description.

Furthermore, it is advantageous, if connecting webs 294, 301 are assigned on the base and cover plate 6, 7 in the connecting regions between the webs, e.g. the longitudinal webs 232, 239 and all other webs with a specific description, in their bearing region on the opposite plate, i.e. webs formed on the base plate 6 in the region of the inside face of the cover plate 7 or vice versa.

Said connecting webs 294, 301 have a much smaller width 314 than the thickness 313 of the webs, e.g. the curved web 231 and/or the centering webs 220, the longitudinal webs 219, 226, the stop webs 206 and the compartment webs 201.

A height 315 of the connecting webs 294, 301 is between 0.01 and 0.5 mm. The said connecting webs 294, 301 during the ultrasonic welding serve mainly as so-called energy directors, in which a connection between the respective web and the opposite base plate or cover plate 6, 7 is formed. By the arrangement of the energy directors spaced apart in longitudinal direction of the individual webs, it is also possible to create regions in the storage case 1 which permit a certain elastic movement perpendicular to the top side 10 of the cover plate 7. This has the advantage that an increase in volume required to insert articles, in particular articles of daily use 9, to lock the articles into corresponding mounts or mounting noses without breaking the permanent connection in the region of the adhesive or weld joint, is avoided. Also on adhering the two parts it is advantageous to perform the adhesion according to the connecting webs 294, 301 shown in the drawings by thin dashes. The distance between the individual connecting webs 294, 301 can be selected with respect to the required elastic restoring deformation of the cover plates.

Of course, it is also possible within the scope of the invention that by using parallel webs which overlap at least in height or extend over the entire internal height 311 to use the adjacent webs on fitting the cover plate 7 to the base plate 6 as guiding elements to centre the two parts.

In addition, additional centering means, such as inclined surfaces 316 inclined relative to the top side 10 of the cover plate 7 can be provided, with which the cover plate 7 can be centered and positioned relative to the base plate 6 allowing for manufacturing tolerances.

Of course, it is also possible to provide parts of the surfaces of the storage case 1 or the swivel plate 28, in particular the top side 10 of the cover plate 7 with a corresponding galvanic coating or a coating applied or adhered in a different way, which e.g. can be reflective, in order to serve as a mirror. Naturally it is also possible to provide the top side 10 or the opposite bottom side 19 of the base plate 6 at least partly with solar cells in order to be able to operate an energy store for further applications in the plate, e.g. a VHF receiver or emergency transmitter for stating position or signal lights or the like.

The distribution and arrangement of the individual articles inside the inner chamber of the card-shaped storage case 1 can be modified as desired.

Within the scope of the invention individual parts of the individual embodiments can be Out together in any combination so that not only individual parts or groups of parts can form the subject matter of separate, independent subject matters, but also individual parts, in particular the design of the storage compartments 8 of the individual embodiments are interchangeable, as well as the arrangement of the webs or connecting webs 294, 301. Most of all the embodiment is advantageous in which the recesses are arranged partly in the base plate 6 and partly in the cover plate 7 or only one base plate and one cover plate 6, 7 are provided which are kept spaced apart by webs of corresponding height or projecting webs extending over the entire internal height 311.

The card-shaped storage case I can be manufactured from any material, but particularly plastic by means of an injection moulding process or an extrusion or embossing process. It is also possible to use other materials such as aluminum, wood, cardboard or other materials.

Of course, it is possible that the card-shaped storage case I is also provided with additional retaining elements such as projecting holding noses or the like for mounting and holding credit cards, identity cards or possibly also money.

It should be noted that individual embodiment details, in particular those characterised in the sub-claims, may represent the subject matter of separate inventions. Moreover, any detail of an embodiment variant may be combined with one or more other details of a different embodiment variant.

Finally, it should be noted that for a better understanding of the figures, individual parts or parts of figures the latter have not all been drawn to scale, e.g. have been enlarged disproportionally, like the connecting webs 294, 301.

| List of Reference Numbers | |
|---|---|
| 1 | storage case |
| 2 | width |
| 3 | length |
| 4 | longitudinal side face |
| 5 | transverse side face |
| 6 | base plate |
| 7 | cover plate |
| 8 | storage compartment |
| 9 | article of daily use |
| 10 | top side |
| 11 | inclined surface |
| 12 | angle of inclination |
| 13 | graduation |
| 14 | linear measure |
| 15 | knife |
| 16 | knife blade |
| 17 | knife handle |
| 18 | connecting surface |
| 19 | bottom side |
| 20 | recess groove |
| 21 | grip surface |
| 22 | file |
| 23 | storage opening |
| 24 | recess |
| 25 | file handle |
| 26 | scissors |
| 27 | scissor grip |
| 28 | swivel plate |
| 29 | corner area |
| 30 | swivel pin |
| 31 | swivel mount |
| 32 | guide slot |
| 33 | tweezers |
| 34 | toothpick |
| 35 | thickness |
| 36 | enveloping surface |
| 37 | base plate thickness |
| 38 | groove base |
| 39 | groove depth |
| 40 | groove width |
| 41 | groove side face |
| 42 | stepped section |
| 43 | curved surface |
| 44 | part length |
| 45 | shoulder |
| 46 | part groove depth |
| 47 | face |
| 48 | part section |
| 49 | base surface |
| 50 | height |
| 51 | radius |
| 52 | central point |
| 53 | guide surface |
| 54 | stop face |
| 55 | end face |
| 56 | distance |
| 57 | centre line |
| 58 | slot depth |
| 59 | base height |
| 60 | flank face |
| 61 | opening |
| 62 | opening depth |
| 63 | face |
| 64 | guide profile |
| 65 | guide surface |
| 66 | radius of curvature |
| 67 | distance |
| 68 | face |
| 69 | face radius |
| 70 | recess |
| 71 | guide arrangement |
| 72 | ring face |
| 73 | top side |
| 74 | inner ring face |
| 75 | inner side |
| 76 | collar |
| 77 | web |

-continued

| List of Reference Numbers | |
|---|---|
| 78 | inner face |
| 79 | outer ring face |
| 80 | extension |
| 81 | knife recess groove |
| 82 | groove width |
| 83 | groove side |
| 84 | distance |
| 85 | face |
| 86 | distance |
| 87 | groove base |
| 88 | groove depth |
| 89 | needle recess groove |
| 90 | centre line |
| 91 | angle |
| 92 | distance |
| 93 | length |
| 94 | groove width |
| 95 | depth |
| 96 | file recess groove |
| 97 | groove side face |
| 98 | distance |
| 99 | groove width |
| 100 | groove length |
| 101 | distance |
| 102 | groove base |
| 103 | groove depth |
| 104 | groove depth |
| 105 | implement groove |
| 106 | groove length |
| 107 | groove side face |
| 108 | distance |
| 109 | groove width |
| 110 | groove depth |
| 111 | scissor recess groove |
| 112 | groove side face |
| 113 | distance |
| 114 | face region |
| 115 | face |
| 116 | distance |
| 117 | groove side face |
| 118 | distance |
| 119 | distance |
| 120 | distance |
| 121 | end edge |
| 122 | distance |
| 123 | groove base |
| 124 | groove depth |
| 125 | groove base |
| 126 | groove depth |
| 127 | tweezers recess groove |
| 128 | groove length |
| 129 | groove width |
| 130 | groove depth |
| 131 | centre line |
| 132 | radius |
| 133 | central point |
| 134 | distance |
| 135 | groove width |
| 136 | groove depth |
| 137 | distance |
| 138 | end face |
| 139 | distance |
| 140 | groove depth |
| 141 | groove width |
| 142 | recess width |
| 143 | recess side face |
| 144 | depth |
| 145 | radius |
| 146 | opening width |
| 147 | groove length |
| 148 | length |
| 149 | groove depth |
| 150 | groove depth |
| 151 | sloping portion |
| 152 | depth |
| 153 | groove side face |
| 154 | distance |

-continued

| List of Reference Numbers | |
|---|---|
| 155 | angle |
| 156 | length |
| 157 | groove width |
| 158 | distance |
| 159 | groove depth |
| 160 | distance |
| 161 | distance |
| 162 | groove side face |
| 163 | groove side face |
| 164 | depth |
| 165 | curvature face |
| 166 | radius |
| 167 | groove width |
| 168 | length |
| 169 | groove depth |
| 170 | groove depth |
| 171 | radius |
| 172 | central point |
| 173 | distance |
| 174 | face |
| 175 | inside radius |
| 176 | distance |
| 177 | inside edge |
| 178 | external distance |
| 179 | distance |
| 180 | stepped portion |
| 181 | ring face |
| 182 | depth |
| 183 | surface |
| 184 | height |
| 185 | pin diameter |
| 186 | height |
| 187 | thickness |
| 188 | web width |
| 189 | length |
| 190 | chewing gum |
| 191 | central web |
| 192 | side web |
| 193 | shoulder |
| 194 | shoulder depth |
| 195 | central part |
| 196 | recess |
| 197 | marginal ledge |
| 198 | marginal ledge height |
| 199 | web |
| 200 | web height |
| 201 | compartment web |
| 202 | toothpick recess groove |
| 203 | ball pen recess groove |
| 204 | part web |
| 205 | needle |
| 206 | stop web |
| 207 | clamping web |
| 208 | clamping surface |
| 209 | base surface |
| 210 | height |
| 211 | holding projecton |
| 212 | centering web |
| 213 | free position web |
| 214 | free position |
| 215 | centering web |
| 216 | face |
| 216' | angle |
| 217 | centering web height |
| 218 | web height |
| 219 | longitudinal web |
| 220 | centering web |
| 221 | depth |
| 222 | stop web |
| 223 | clamping web |
| 224 | centering web height |
| 225 | web length |
| 226 | longitudinal web |
| 227 | web height |
| 228 | transverse web |
| 229 | transverse web height |
| 230 | clamping web |

-continued

| List of Reference Numbers | |
|---|---|
| 231 | curved web |
| 232 | longitudinal web |
| 233 | shaping |
| 234 | depth |
| 235 | stop web |
| 236 | groove width |
| 237 | clamping web length |
| 238 | centering web |
| 239 | longitudinal web |
| 240 | distance |
| 241 | distance |
| 242 | end region |
| 243 | connecting web |
| 244 | swivel bearing bore |
| 245 | centering web |
| 246 | corner region |
| 247 | centering extension |
| 248 | inner side |
| 249 | height |
| 250 | delimiting web |
| 251 | longitudinal web |
| 252 | inner side |
| 253 | vertical face |
| 254 | curved surface |
| 255 | opening width |
| 256 | width |
| 257 | curved web |
| 258 | longitudinal web |
| 259 | centering recess |
| 260 | longitudinal web |
| 261 | depth |
| 262 | recess face |
| 263 | cross web |
| 264 | clamping web |
| 265 | face depth |
| 266 | longitudinal web |
| 267 | upper side |
| 268 | base surface |
| 269 | height |
| 270 | depth |
| 271 | web height |
| 272 | recess |
| 273 | guide web |
| 274 | web |
| 275 | surface |
| 276 | bearing face |
| 277 | height |
| 278 | longitudinal web |
| 279 | centering web |
| 280 | centering extension |
| 281 | base surface |
| 282 | projection height |
| 283 | pin web |
| 284 | stop web |
| 285 | swivel stop |
| 286 | stop web |
| 287 | arresting projection |
| 288 | delimiting web |
| 289 | shaping |
| 290 | edge web |
| 291 | part web |
| 292 | shaping |
| 293 | knife handle widh |
| 294 | connecting web |
| 295 | inside surface |
| 296 | connecting web height |
| 297 | connecting web top side |
| 298 | gap width |
| 299 | total height |
| 300 | groove base thickness |
| 301 | connecting web |
| 302 | web underside |
| 303 | web height |
| 304 | needle web |
| 305 | web surface |
| 306 | pin extenstion |
| 307 | web surface |

-continued

| List of Reference Numbers | |
|---|---|
| 308 | web surface |
| 309 | removal opening |
| 310 | free position |
| 311 | internal height |
| 312 | wall thickness |
| 313 | thickness |
| 314 | width |
| 315 | height |
| 316 | inclined surface |

What is claimed is:

1. A card-shaped storage case comprising:

a cover plate having longitudinal side faces and transverse side faces;

a base plate having longitudinal side faces and transverse side faces; said cover plate and base plate connected together, spaced apart from each other by a plurality of webs; and accommodations between said cover plate and said base plate configured for internal storage of articles, said cover plate and said base plate being spaced apart from each other by said webs such that said accommodations are accessible from the exterior via storage openings;

wherein one of said accommodations is defined in sections by two adjacent curved webs extending between opposing said transverse side faces and running curved parallel relative to one another as well as configured for retaining an article therebetween, so that while the article is received in said one of said accommodations the article is deformed elastically by said adjacent curved webs and held automatically by frictional grip within said one of said accommodations.

2. A card-shaped storage case as in claim 1, wherein:

said cover plate comprises a top side, and an inner surface;

said base plate comprises a top side and an inner surface; and said webs projecting perpendicularly from said inner surface of said base plate toward said cover plate and from said inner surface of said cover plate toward said base plate to space apart said base plate and said cover plate, thereby defining said accommodations.

3. A card-shaped storage case as in claim 1, wherein said webs comprise a first web extending from said base plate towards said cover plate, and a second web extending from said cover plate towards said base plate and opposite said first web, said first and second webs meeting between said plates and together forming a combined web extending over an internal height measured between said inner surfaces.

4. A card-shaped storage case as in claim 2, wherein said webs comprise a first web extending from said base plate and a second web extending from said cover plate arranged adjacent and parallel to each other to form a double wall.

5. A card-shaped storage case as in claim 1, wherein said webs project perpendicularly from said plates and have a height corresponding essentially to an internal height measured between inner surfaces of said plates.

6. A card-shaped storage case as in claim 1, wherein said cover plate and said base plate are affixed together by one of adhesive bonding and ultrasonic welding.

7. A card-shaped storage case as in claim 1, wherein said webs include connecting webs projecting from inner surfaces of at least one of said base plate and said cover plate to couple together said base plate and said cover plate.

8. A card-shaped storage case as in claim 1, wherein at least some of said webs are generally parallel and spaced at intervals along said plates such that said webs form a substructure for stiffening said plates against bending and for holding said base plate and said cover plate at a distance from each other so as to define said accommodations.

9. A card-shaped storage case as in claim 1, wherein said base plate comprises a top side and an inner surface;

said cover plate comprises a top side and an inner surface;

said base and cover plates are coupled together with said inner surface of said base plate spaced from said inner surface of said cover plate to form an interior space therebetween;

whereby said plurality of webs extend between said inner surfaces of said base and cover plate to divide said interior space into a plurality of said accommodations;

and said webs extend from said inner surface to one of said base and cover plates to contact said inner surface of the other of said base and cover plates.

10. A card-shaped storage case as in claim 1, wherein:

said cover plate comprises a top side and an inner surface;

said base plate comprises a top side and an inner surface;

at least one of said base and cover plates having on its inner surface connecting webs projecting perpendicularly from said inner surface of said base plate and cover plate are coupled together by said connecting webs.

11. A card-shaped storage case comprising:

a cover plate having a top side, an inner surface, longitudinal side faces, and transverse side faces;

a base plate having a top side, an inner surface, longitudinal side faces, and transverse side faces;

a plurality of webs projecting perpendicularly from said inner surface of said base plate toward said cover plate and from said inner surface of said cover plate toward said base plate to connect and space apart said base plate and said cover plate and to form accommodations between said cover plate and said base plate configured for internal storage of articles, wherein said accommodations are accessible from the exterior via storage openings;

wherein one of said accommodations is defined in sections by two adjacent webs, said adjacent webs extending between opposing transverse side faces and having at least two opposing part webs spaced apart in a direction of the length of said one of said accommodations and configured for retaining an elongate article therebetween such that when said elongate article is inserted into said one of said accommodations, said elongate article is deformed elastically by said part webs and held automatically by frictional grip within said one of said accommodations; and wherein said webs include a first web extending from said base plate and a second web extending from said cover plate, the first and second webs being arranged adjacent and parallel to each other to form a double wall.

12. A card-shaped storage case as in claim 11, wherein one or more of said webs projecting perpendicularly from said plates have a height corresponding essentially to an internal height measured between the inner surfaces of said plates.

13. A card-shaped storage case as in claim 11, wherein said cover plate and said base plate are affixed together by one of adhesive bonding and ultrasonic welding.

14. A card-shaped storage case as in claim 11, wherein said part webs are fitted relative to one another at an angle to said transverse side faces.

15. A card-shaped storage case as in claim 14, wherein said part webs are spaced apart by a groove width parallel to said transverse side faces, wherein said groove width is smaller than a diameter of said elongate article.

16. A card-shaped storage case as in claim 11, wherein said webs extend from said inner surface of one of said base and cover plates to contact said inner surface of the other of said base and cover plates.

* * * * *